US007806508B2

(12) United States Patent
Hirato

(10) Patent No.: US 7,806,508 B2
(45) Date of Patent: Oct. 5, 2010

(54) INK-JET RECORDING METHOD AND INK-JET RECORDING APPARATUS

(75) Inventor: Katsuyuki Hirato, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 297 days.

(21) Appl. No.: 12/026,444

(22) Filed: Feb. 5, 2008

(65) Prior Publication Data

US 2008/0186341 A1 Aug. 7, 2008

(30) Foreign Application Priority Data

Feb. 6, 2007 (JP) ..... P2007-026961

(51) Int. Cl.
*B41J 2/165* (2006.01)

(52) U.S. Cl. ..... 347/35

(58) Field of Classification Search ..... 347/5, 347/19, 22, 23, 35

See application file for complete search history.

(56) References Cited

U.S. PATENT DOCUMENTS

| | | | | |
|---|---|---|---|---|
| 6,460,963 | B1 * | 10/2002 | Endo | 347/19 |
| 6,779,867 | B2 * | 8/2004 | Shimizu et al. | 347/23 |
| 2003/0081045 | A1 | 5/2003 | Shimizu et al. | |
| 2006/0055715 | A1 | 3/2006 | Nakahara et al. | |

FOREIGN PATENT DOCUMENTS

| | | | |
|---|---|---|---|
| DE | 199 29 316 | A1 | 12/2000 |
| JP | 55-139269 | A | 10/1980 |
| JP | 2006-76247 | A | 3/2006 |

* cited by examiner

*Primary Examiner*—Huan H Tran
(74) *Attorney, Agent, or Firm*—Birch, Stewart, Kolasch & Birch, LLP

(57) ABSTRACT

An ink-jet recording method for forming an image by discharging a liquid functional material onto a recording medium by a full-line type ink-jet head having discharge nozzles arranged in a widthwise direction substantially perpendicular to a transporting direction of the recording medium, includes: determining a range free of image recording between images recorded intermittently on the recording medium; effecting discharge or pressurization purge of the liquid functional material in the range free of image recording on the recording medium; and lowering a fluidity of the liquid functional material discharged.

10 Claims, 7 Drawing Sheets

INK-JET RECORDING METHOD AND INK-JET RECORDING APPARATUS

FIELD OF THE INVENTION

The present invention relates to an ink-jet recording method and an ink-jet recording apparatus for effecting image formation on a recording medium by means of ink jets by using ink which is cured by active energy rays such as an electron beam or ultraviolet rays.

BACKGROUND OF THE INVENTION

Ink-jet apparatuses in which image formation is effected by discharging a functional material such as ink onto a recording medium by using an ink-jet head has characteristics such as that they are environmentally friendly, that high-speed recording is possible on various recording media, and that bleeding is unlikely to occur and high-resolution images can be obtained. Further, if a full-line head system in which heads are arrayed over the entire recording width is used, an even higher speed is possible, and development is underway which combines the full-line head system and an ultraviolet-curable ink for which a drying process is not required in many cases.

Meanwhile, in such an ink-jet recording apparatus, the ink-jet head has a multiplicity of nozzles, and if faulty discharge from the nozzles occurs, it is visibly recognized as an image defect. For this reason, pressurization, suction purge, and preliminary discharge of the ink are generally carried out at timings at which the head moves to the position of a maintenance station for each time period. However, in the recording apparatus in which a web-like recording medium is fed, the head is generally fixed to the apparatus, and the recording medium is constantly present below the head, so that ink refresh operation cannot be performed. When maintenance is actually provided, either the head or a recording material transporting device is moved to execute the maintenance of the head. However, at this juncture, a reference position must be reset, so that there has been a high probability of occurrence of a faulty recording image due to positional offset.

In view of such a background, ink-jet recording methods have been disclosed in which preliminary maintenance discharge is carried out for suppressing the occurrence of faulty nozzle discharge (e.g., refer to JP-A-55-139269 and JP-A-2006-76247 (corresponding to US2006/0055715A1)).

SUMMARY OF THE INVENTION

In the ink-jet recording methods disclosed in JP-A-55-139269 and JP-A-2006-76247 (corresponding to U.S.2006/0055715A1), a configuration is shown in which preliminary discharge dots of a visually undiscernable measure are formed in an image portion or a non-image portion. In this configuration, since the preliminary discharge dots are present in a range which is subject to viewing, the size of these discharge dots must be of a visually undiscernable measure. However, the amount of discharge of such a measure has not been sufficient for the recovery and prevention of faulty discharge. In addition, particularly when preliminary discharge or pressurization is performed on a nonpermeable recording medium, an effect is exerted at the time of executing a subsequent process such as taking up or cutting owing to the liquid functional material accumulated on the recording material, so that preliminary discharge or pressurization is difficult to perform on the recording medium.

The present invention has been devised in view of the above-described circumstances, and its object to provide an ink-jet recording method and an ink-jet recording apparatus capable of providing effective maintenance discharge without the occurrence of a deviation of a reference position in the full-line head system.

The above-described object of the invention is attained by the following configurations:

(1) An ink-jet recording method for forming an image by discharging a liquid functional material onto a recording medium by a full-line type ink-jet head having discharge nozzles arranged in a widthwise direction substantially perpendicular to a transporting direction of the recording medium, comprising the steps of: determining a range free of image recording between images recorded intermittently on the recording medium; effecting discharge or pressurization purge of the liquid functional material in the range free of image recording on the recording medium; and lowering the fluidity of the liquid functional material discharged.

(2) The ink-jet recording method according to (1) above, wherein means for lowering the fluidity is one of heating, cooling, irradiation with active energy rays, and introduction of a fluidity lowering material.

According to the ink-jet recording method thus configured, a range free of image recording is determined over the entire length of the head between images recorded intermittently on the recording medium, the discharge or pressurization purge is effected in the range free of image recording, and the fluidity of the liquid functional material in the range free of image recording is lowered. Consequently, it is possible to provide maintenance discharge in the full-line head system without needing to execute structural change such as the movement of the head or the movement of a recording material transport passage and, hence, without the occurrence of a deviation of a reference position.

(3) The ink-jet recording method according to (1) or (2) above, wherein the discharge or pressurization purge in the range free of image recording is executed with respect to a nozzle which has not been discharging for a predetermined fixed time duration within a period when the probability of occurrence of faulty discharge is low.

According to the ink-jet recording method thus configured, since the discharge or pressurization purge is executed in the range free of image recording by a nozzle which has not been discharging for a predetermined fixed time duration within a period when the probability of occurrence of faulty discharge is low, it is possible to prevent the occurrence of faulty discharge from the nozzle.

(4) The ink-jet recording method according to (1) or (2) above, wherein the discharge or pressurization purge in the range free of image recording is executed speedily after the occurrence of faulty discharge with respect to a nozzle in which faulty discharge has occurred.

According to the ink-jet recording method thus configured, it is possible to overcome the faulty discharge speedily after the occurrence of faulty discharge with respect to the nozzle in which faulty discharge has occurred, and it is possible to execute maintenance while suppressing unnecessary consumption of the liquid functional material.

(5) The ink-jet recording method according to any one of (1) to (4) above, wherein the transport speed of the recording medium is decreased or the transport is stopped only during the execution of the discharge or pressurization purge in the range free of image recording.

According to the ink-jet recording method thus configured, the discharge or pressurization purge in the range free of image recording is made reliable, and the effect on the recorded image can be eliminated more reliably.

(6) The ink-jet recording method according to any one of (1) to (5) above, wherein during the discharge in the range free of image recording, either one of an increase in an amount of droplets per dot and a decrease of a discharge frequency than at least during image recording is carried out.

(7) The ink-jet recording method according to (6) above, wherein the increase in the amount of droplets per dot is a voltage increase or an increase in the number of discharge drops.

According to the ink-jet recording method thus configured, it is possible to improve the head maintenance effect through the discharge in the range free of image recording.

(8) The ink-jet recording method according to any one of (1) to (7) above, wherein an inspection pattern is recorded by the discharge in the range free of image recording.

According to the ink-jet recording method thus configured, as the maintenance discharge in the range free of image recording is actively used for an inspection pattern, the liquid functional material can also be used for an image inspection pattern simultaneously with the maintenance, thereby making it possible to effectively utilize the liquid functional material.

(9) The ink-jet recording method according to any one of (1) to (8) above, wherein the discharge in the range free of image recording indicates a predetermined cutting position between the images.

According to the ink-jet recording method thus configured, since the discharge in the range free of image recording indicates a predetermined cutting position between the images, the liquid functional material for maintenance can be utilized as a mark for accurately specifying the cutting position, thereby making it possible to effectively utilize the liquid functional material.

(10) An ink-jet recording apparatus comprising: a head controller for determining a range free of image recording between images recorded intermittently on a recording medium on the basis of inputted image data, and for effecting discharge or pressurization purge of a liquid functional material within this determined range; and a unit for lowering the fluidity of the liquid functional material discharged.

(11) The ink-jet recording apparatus according to (10) above, wherein the unit for lowering the fluidity is one of a heating section, a cooling section, irradiation with active energy rays, and introduction of a fluidity lowering material.

According to the ink-jet recording apparatus thus configured, the head controller effects the discharge or pressurization purge of the liquid functional material in the range free of image recording over the entire length of the head between images recorded intermittently on the recording medium on the basis of inputted image data, and lowers the fluidity of the liquid functional material in the range free of image recording. Consequently, it is possible to provide maintenance discharge in the full-line head system without needing to execute structural change such as the movement of the head or the movement of a recording material transport passage and, hence, without the occurrence of a deviation of a reference position.

(12) The ink-jet recording apparatus according to (10) or (11) above, further comprising: a faulty-discharge-nozzle detector capable of detecting a nozzle in which faulty discharge has occurred.

According to the ink-jet recording apparatus thus configured, since the faulty-discharge-nozzle detector detects a nozzle in which faulty discharge has occurred, by actively effecting discharge or pressurization purge only with respect to this nozzle, it is possible to execute maintenance while suppressing unnecessary consumption of the liquid functional material.

According to the ink-jet recording method and the ink-jet recording apparatus of the invention, it is possible to provide effective maintenance discharge without the occurrence of a deviation of a reference position in the full-line head system.

DESCRIPTION OF REFERENCE NUMERALS AND SIGNS

Figure 1:
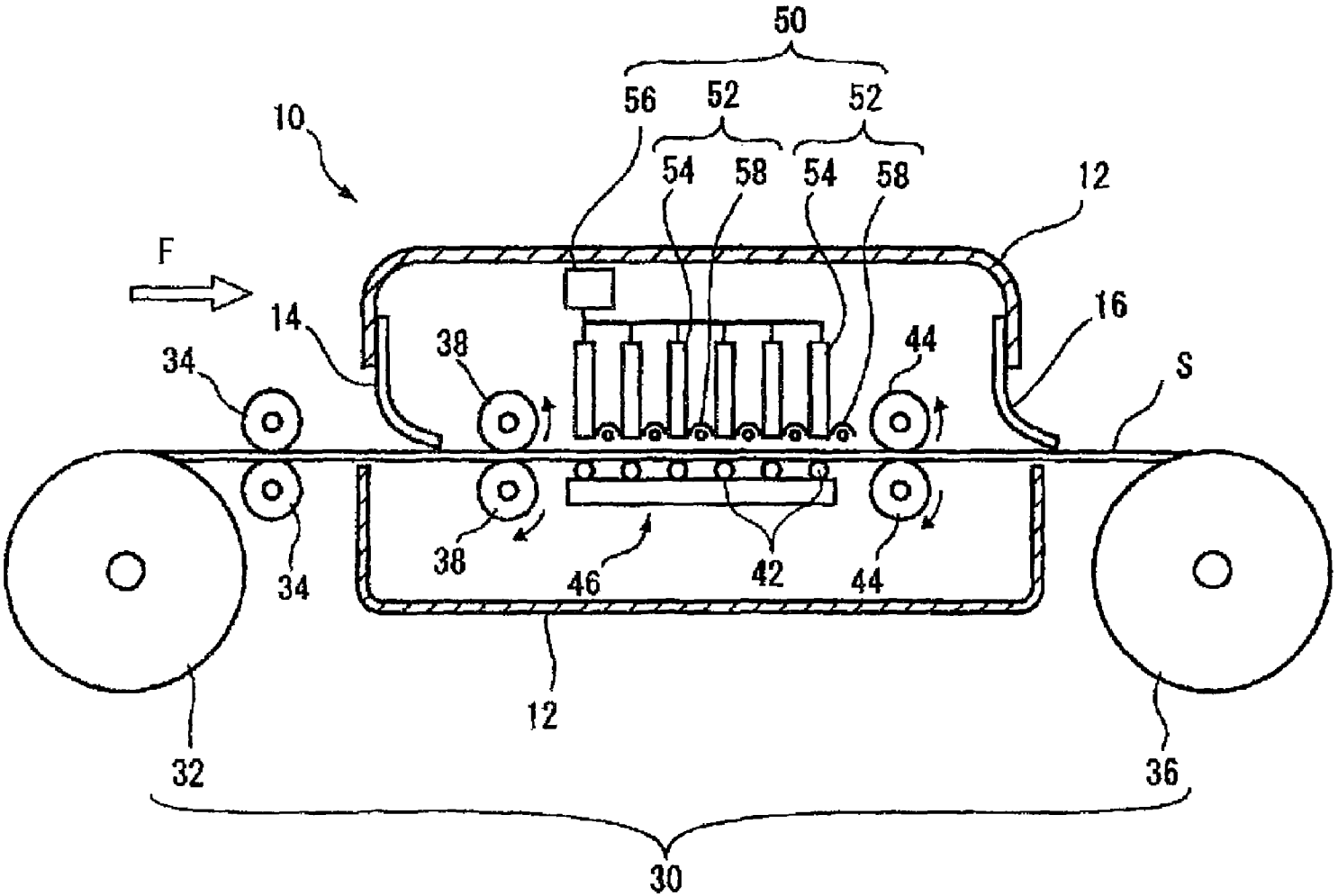
FIG. 1 is a schematic diagram of an ink-jet recording apparatus of a first embodiment in the ink-jet recording method and the ink-jet recording apparatus in accordance with the invention.

10: ink-jet recording apparatus
54: full-line type ink-jet head (discharge nozzle)
56: head driver (head controller)
I: image
L: range free of image recording
P: inspection pattern
S: recording medium

DETAILED DESCRIPTION OF THE INVENTION

Referring now to the drawings, a detailed description will be given of an ink-jet recording method and an ink-jet recording apparatus in accordance with the invention.

First Embodiment

FIG. 1 shows a first embodiment of the ink-jet recording method and the ink-jet recording apparatus in accordance with the invention, and FIG. 1 is a schematic diagram of the ink-jet recording apparatus in accordance with the first embodiment. It should be noted that, in this embodiment, an ink-jet recording apparatus 10 uses a UV-curable ink which is cured by irradiation with ultraviolet rays as an active energy ray-curable ink which is a liquid functional material.

In FIG. 1, a web-like recording medium S wound around a feed roll 32 is paid out by means of transport rollers 34, passes a flexible light shielding door 14, and is transported into a housing 12 of the ink-jet recording apparatus 10. This transported recording medium S is fed out from a flexible light shielding door 16 disposed on the opposite side of the housing 12 and is taken up onto a takeup roll 36.

The recording medium S transported into the housing 12 is held by transporting and holding rollers 38 and is fed onto a plurality of supporting and transporting rollers 42. Further, the recording medium S is held by transporting and holding rollers 44 disposed on the downstream side with the supporting and transporting rollers 42 located between the transporting and holding rollers 38 and the transporting and holding rollers 44. In this state, the recording medium S is subjected to scan transport by the supporting and transporting rollers 42 and is fed out from the light shielding door 16. An image recording section 50 is disposed over the supporting and transporting rollers 42 at an opposing position with the recording medium S placed therebetween. Thus a scanning and transporting section 30 is formed by the feed roll 32, the takeup roll 36, the transport rollers 34, the transporting and holding rollers 38 and 44, and the supporting and transporting rollers 42. The plurality of supporting and transporting rollers 42 are supported by a pressing unit 46, and this pressing unit 46 is movable in a direction in which it is brought into close proximity with or moved away from head units 52 of the image recording section 50 by an unillustrated drive mechanism.

With respect to the recording medium S being scanned and transported on the supporting and transporting rollers 42, the image recording section 50 performs ink-jet image recording and irradiation with and fixation by active energy rays (ultraviolet light in this embodiment). An ink storage section for storing ink and supplying it to the image recording section 50 through an unillustrated supply passage is provided in the housing 12.

In the image recording section 50, ink-jet heads 54 of the head units 52 are provided with distal ends of their ink discharge portions facing the transport surfaces of the supporting and transporting rollers 42 at an image recording position. The heat units 52 are full-line type heads whose array coincides with the widthwise length of the recording medium S, and piezoelectric type heads are adopted. Further, each head unit 52 discharges an ink capable of curing by active energy rays toward the recording medium S. A head driver 56, which is an ink-jet head drive unit, is connected to each head unit 52 to control the amount of discharge of each color of ink. An active-energy-ray irradiating portion 58 is disposed downstream of the ink-jet head 54. Sets of the ink-jet head 54 and the active-energy-ray irradiating portion 58 in the number of inks (6 sets in FIG. 1) are held and arranged in an unillustrated head holder in a juxtaposed manner in the downstream direction so as to form the head units 52. In addition, an unillustrated ink supplying section is connected to the image recording section 50 for supplying ink.

In this embodiments the head units 52 are driven under control by the head driver 56 to repeatedly and intermittently print an image I of a triangular shape (example) shown in FIG. 3 referred to later on the recording medium S on the basis of the inputted image data (in this case, data for labeling). At this time, the image I is, for example, a label which is affixed to a beer bottle or the like.

Next, referring to FIGS. 2 and 3, a description will be given of the ink-jet recording method using the ink-jet recording apparatus 10 in accordance with this embodiment.

Figure 2:
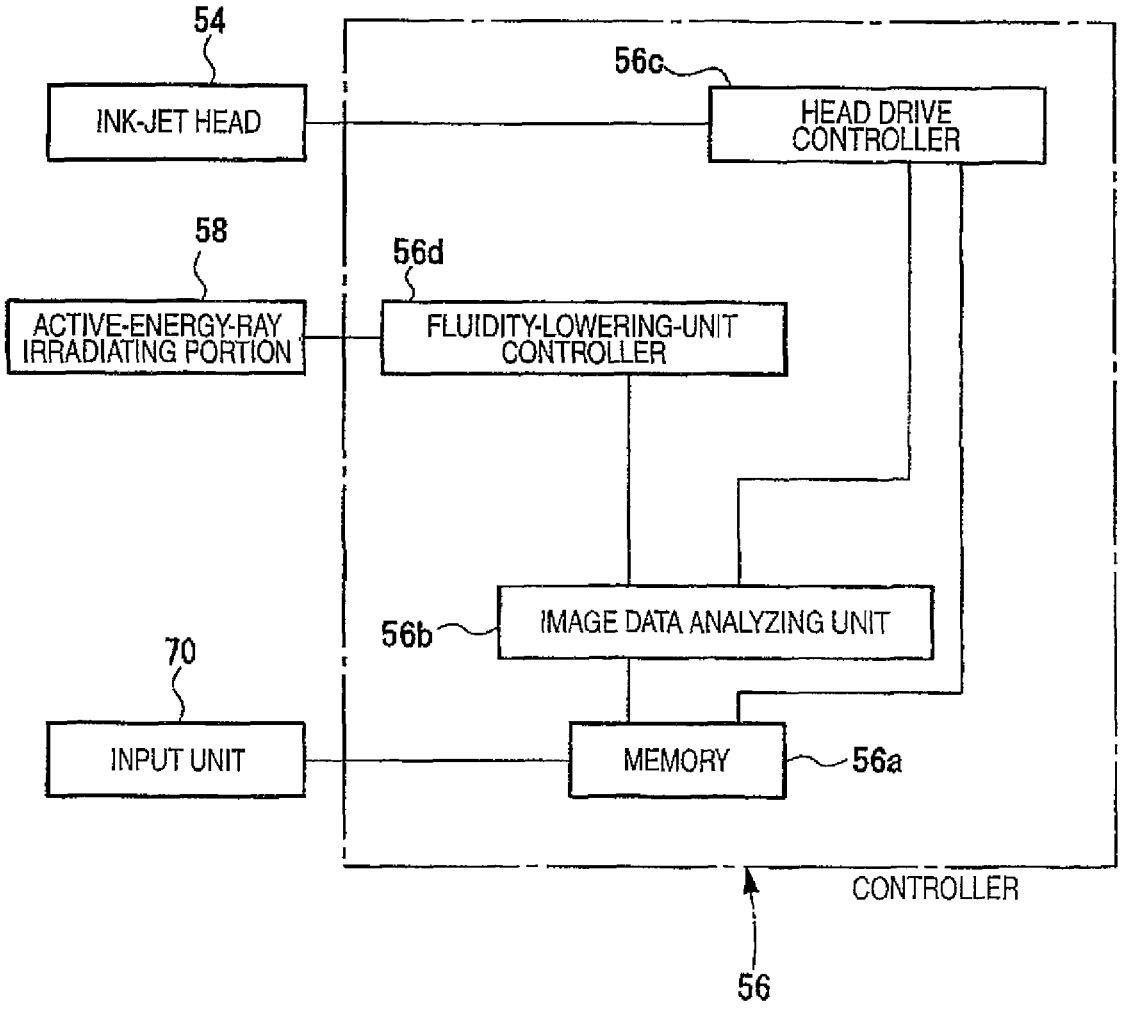
FIG. 2 is a block diagram of a controller for controlling the ink-jet recording apparatus shown in FIG 1.
Figure 3:
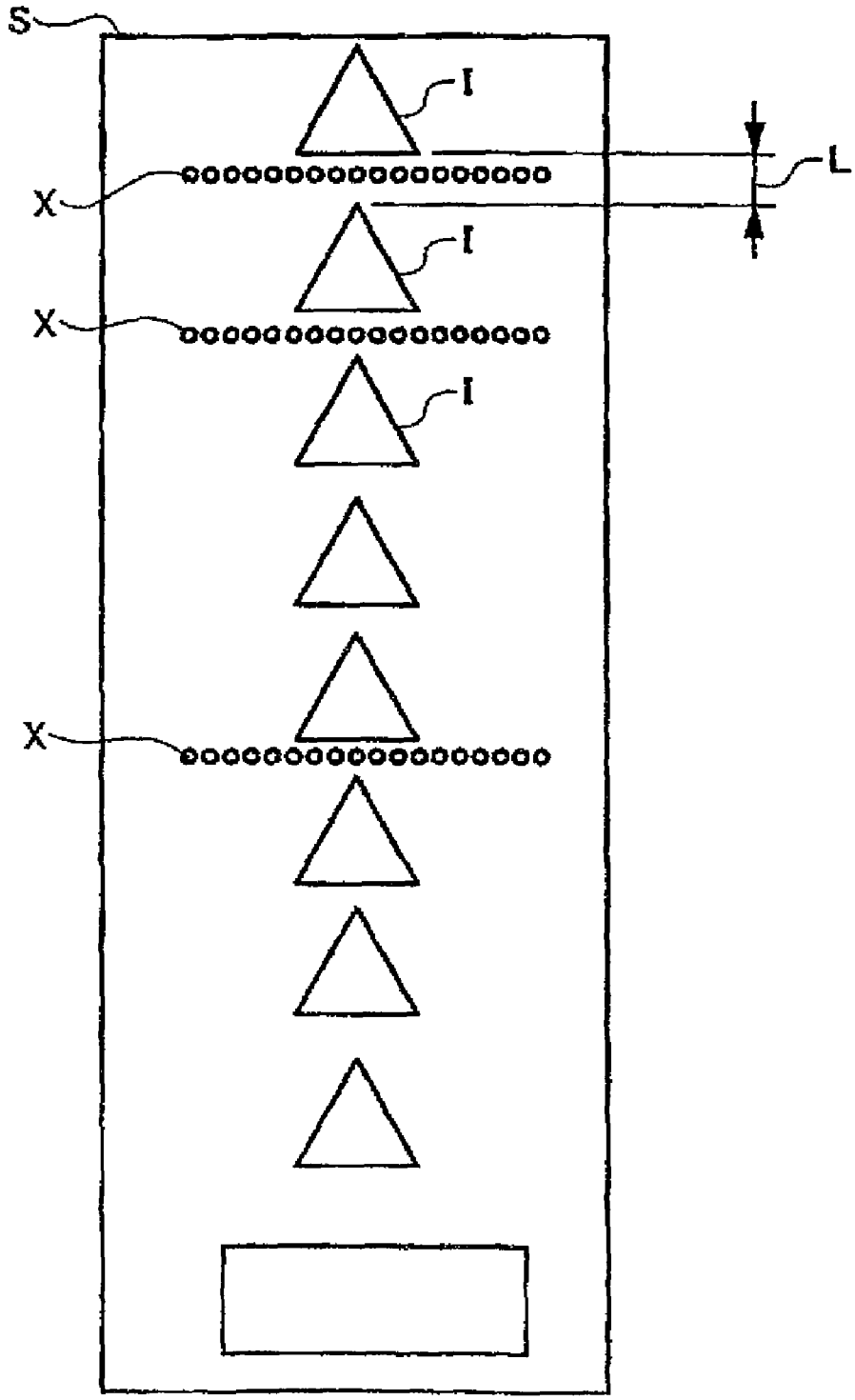
FIG. 3 is a plan view of a recording medium after printing in the ink-jet recording apparatus shown in FIG. 1.

FIG. 2 is a block diagram of a controller for controlling the ink-jet recording apparatus shown in FIG. 1, and FIG. 3 is a plan view of the recording medium after printing in the ink-jet recording apparatus shown in FIG. 1.

As shown in FIG. 2, the head driver 56 is comprised of a memory 56*a* for storing recording image data for discharging ink by the ink-jet head 54; an image data analyzing unit 56*b* for analyzing the shape of the image I to specify an image position and a position where the image is absent (non-image position); a head drive controller 56*c* for controlling the discharge from the ink-jet head 54 upon receiving the recording image data from the memory 56*a* and the recording image data analyzed by the image data analyzing unit 56*b*; and an ink-fluidity-lowering-unit controller 56*d* for controlling an ink fluidity lowering unit (the active-energy-ray irradiating portion 58 in this embodiment) at the non-image position on the basis of the shape analyzed by the image data analyzing unit 56*b*.

It should be noted that the recording image data stored in the memory 56*a* can be inputted from an input unit 70 of a computer or the like (not shown) connected to the ink-jet recording apparatus 10.

Next, a description will be given of the operation in the image recording section 50. As described above, in this embodiment, with respect to the recording medium S in the form of continuous paper transported to the position of the image recording section 50, the head unit 52 under control by the head drive controller 56*c* repeatedly and intermittently prints the image I of a triangular shape (example) shown in FIG. 3 on the basis of the recording image data (in this case, data for labeling) stored in the memory 56*a*. At this time, the image I is, for example, a label which is affixed to a beer bottle or the like. The ink adhering to the recording medium S is immediately irradiated with active energy rays by the active-energy-ray irradiating portion 58 and is cured.

Meanwhile, on the basis of the recording image data stored in the memory 56*a*, the image data analyzing unit 56*b* specifies a range L free of image recording over the entire length of the ink-jet head 54 between the images I which are printed. The head drive controller 56*c* controls the ink-jet head 54 so as to discharge the ink in this specified range L as maintenance discharge X. By virtue of such processing, it is possible to provide the maintenance discharge X in the full-line head system without needing to execute structural change such as the movement of the head or the movement of the recording material transport passage and, hence, without the occurrence of a deviation of a reference position. Further, in order to stop the flow of the ink in this maintenance discharge X, the fluidity-lowering-unit controller 56*d* controls the irradiation of active energy rays from the active-energy-ray irradiating portion 58 on the basis of the range L free of image recording specified by the image data analyzing unit 56*b*.

Here, the range L free of the recording of the image I refers to a predetermined cutting position between the images I and is a portion which is ordinarily removed after printing.

It should be noted that the discharge X of the ink in the range L free of image recording need not be effected over the entire range L free of the image, and may be effected intermittently or at random. At this time, the image data analyzing unit 56*b* selects the ink jet head 54 (including the specification of the discharge nozzles) which has not been discharging for a predetermined fixed time duration within a period when the probability of occurrence of faulty discharge is low, and transmits that information to the head drive controller 56*c*. The head drive controller 56*c* provides control for discharging the ink in the range L free of image recording by using only that ink-jet head 54.

Through such a method, it is possible to prevent the occurrence of faulty discharge from the nozzles.

In addition, the head drive controller 56*c* is capable of effecting control for selecting (including the specification of the discharge nozzles) in the image data analyzing unit 56*b* the ink-jet head 54 where faulty discharge has occurred and which has been detected by an unillustrated ink-jet faulty-discharge detector, and for causing the ink to be discharged in the range L free of image recording speedily after the occurrence of faulty discharge by using only that ink-jet head 54. Accordingly, it is possible to execute maintenance while suppressing unnecessary consumption of the ink. The faulty-discharge detector includes a method in which a rendering image is read online or offline by a scanner, a method in which the presence or absence of a discharge droplet is detected by light or acoustic waves, and a method in which the electrical property of a piezoelectric element in the head is detected.

During the period when control for discharging the ink in the range L free of image recording is being effected, the speed of transport by the feed roll 32, the takeup roll 36, the transport rollers 34, the transporting and holding rollers 38 and 44, and the supporting and transporting rollers 42 of the scanning and transporting section 30 is decreased. It should be noted that, instead of decreasing the transport speed, the transport may be stopped. Through such control, the discharge or pressurization purge in the range free of image recording is made reliable, and the effect on the recorded image can be eliminated more reliably.

In addition, the lowering of the discharge frequency is also effective. In this case, since the amount of ink per unit area of the recording medium decreases, the fluidity of the ink can be lowered reliably. Further, the increasing of the amount of droplets per dot is effective in preventing the occurrence of faulty discharge. The method of increasing the amount of droplets includes a method in which the discharge output of the head is electrically increased and a method in which the number of drops is increased.

Here, the increase of the number of drops refers to a burst mode in which a single droplet is discharged continually. However, since the increase of the amount of droplets causes a hindrance to the lowering of fluidity, it is desirable to combine the lowering of the discharge frequency and the increase of the amount of droplets. For example, if the discharge frequency is lowered from 10 kHz to 2 kHz, and the amount of droplets is increased from 12 pl per dot at the time of rendering to 24 pl, the lowering of fluidity and improvement of the effect of prevention of faulty discharge can be made compatible.

It should be noted that, instead of the above-described control of discharge in the range L free of image recording, pressurization purge may be carried out which is an operation of forcibly extruding the ink in the ink-jet head 54 from the nozzle by applying pressure to the head 54. In this case, since a large amount of ink is discharged as compared with the normal discharge for image recording, a certain measure of width in the transporting direction is required for the range L free of image recording.

As for the recording medium S where the ink has thus been discharged in the ranges L free of image recording, these ranges L are cut off and removed, and only the portions where the images I have been rendered are used.

Second Embodiment

Next, referring to FIG. 4, a description will be given of a second embodiment of the ink-jet recording method in accordance with the invention.

Figure 4:
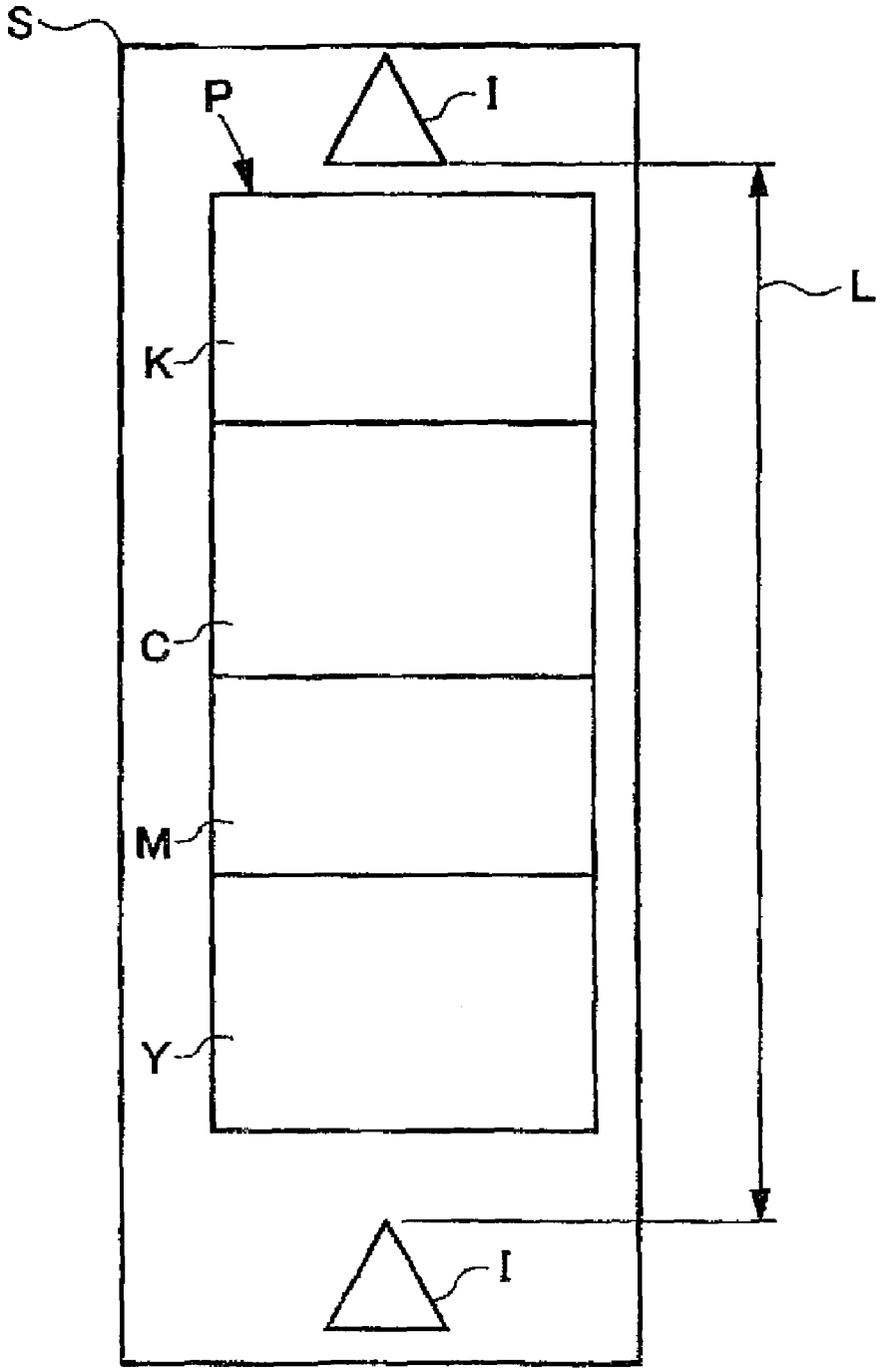
FIG. 4 is a plan view of the recording medium after printing in a second embodiment in the ink-jet recording method and the ink-jet recording apparatus in accordance with the invention.

FIG. 4 is a plan view of the recording medium after printing in the ink-jet recording apparatus. It should be noted that those portions of the ink-jet recording method of the second embodiment that are identical to those of the ink-jet recording method of the first embodiment will be denoted by the same reference numerals or corresponding reference numerals, and the description of the first embodiment will be appropriated.

As shown in FIG. 4, in the second embodiment in accordance with the invention, in the ink-jet recording method using the ink-jet recording apparatus 10, the head driver 56 is capable of effecting control for suspending printing after printing the triangular images I shown in FIG. 4 on the basis of the inputted image data, for determining the range L free of image recording over the entire length of the ink-jet head 54, and for printing an inspection pattern P in this determined range L. Such processing is controlled by the input of an instruction from the input unit 70 to the image data analyzing unit 56*b* or by a predetermined setting in the memory 56*a*.

The inspection pattern P preferably consists of a four-color pattern of K (black), C (cyan), M (magenta), and Y (yellow). Here, the range L free of the recording of the images I refers to a predetermined cutting position between the images I and is a portion which is removed after printing. Through such processing, as the discharge ink is used also for an image inspection pattern simultaneously with the maintenance, it becomes possible to effectively utilize the discharge ink for maintenance which was irrelevant to image recording.

At this time, the image data analyzing unit 56*b* may provide control for selecting the ink jet head 54 (including the specification of the discharge nozzles) which has not been discharging for a predetermined fixed time duration within a period when the probability of occurrence of faulty discharge is low, and for printing a single color inspection pattern P in the range L free of image recording by using only that ink-jet head 54.

In addition, the head driver 56 may provide control for selecting (including the specification of the discharge nozzles) in the image data analyzing unit 56*b* the ink-jet head 54 where faulty discharge has occurred and which has been detected by an unillustrated ink-jet faulty-discharge detector, and for printing the single-color inspection pattern P in the range L free of image recording speedily after the occurrence of faulty discharge by using only that ink-jet head 54.

It should be noted that if the ink-jet recording apparatus 10 is an ultraviolet curable type ink-jet recording apparatus, the printed inspection pattern P can be instantaneously cured, so that more effective maintenance discharge can be effected by increasing the amount of ink used.

It should be noted that pressurization purge may be performed instead of the printing of the inspection pattern P in the aforementioned range L free of image recording. When the pressurization purge is performed, the discharge of ink may be performed after suspension for a while.

As for the recording medium S where the inspection pattern P has thus been printed in the range L free of image recording, this range L is cut off and removed, and only the portions where the images I have been rendered are used.

Therefore, according to the ink-jet recording method in accordance with this embodiment, as the inspection pattern P is recorded by the discharge in the range L free of image recording, the ink-jet head 54 in which faulty discharge has occurred can be confirmed by the inspection pattern P. In addition, this inspection pattern P can also be used as an inspection pattern of image quality. As the maintenance discharge in the range free of image recording is actively used for an inspection pattern, the ink can also be used for an image inspection pattern simultaneously with the maintenance, thereby making it possible to effectively utilize the ink which is otherwise used only for maintenance discharge.

Third Embodiment

Figure 5:
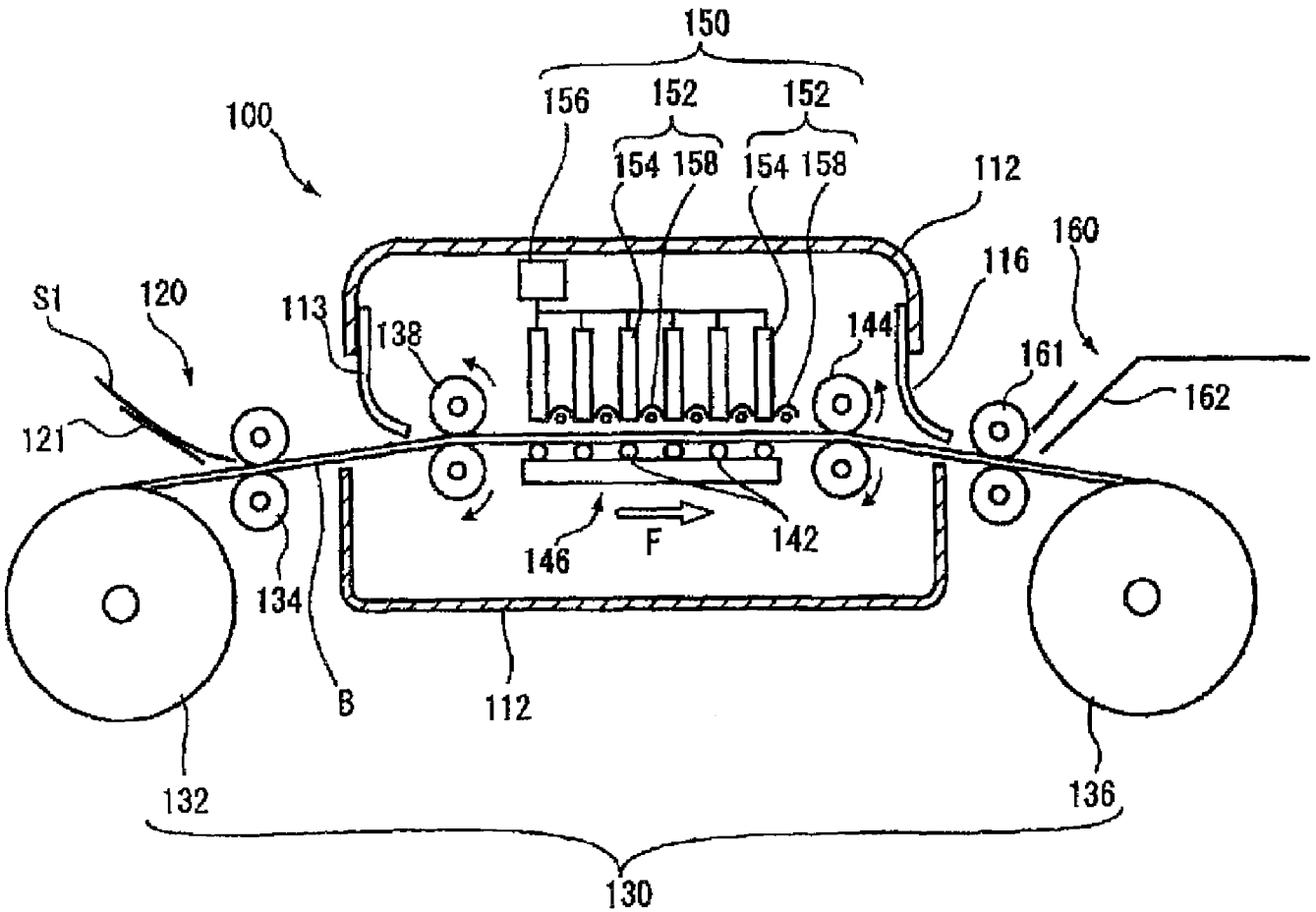
FIG. 5 is a schematic diagram of the ink-jet recording apparatus in accordance with a third embodiment.

Next, referring to FIG. 5, a description will be given of a third embodiment of the ink-jet recording method in accordance with the invention. FIG. 5 is a schematic diagram of the ink-jet recording apparatus.

In FIG. 5, a web-like transport medium B wound around a feed roll 132 is paid out by means of transport rollers 134, passes a flexible light shielding door 113, and is transported into a housing 112 of an ink-jet recording apparatus 100. This transported transport medium B is fed out from a flexible light shielding door 116 disposed on the opposite side of the housing 112 and is taken up onto a takeup roll 136. The form of the transport medium B may be an endless belt which is stretched between the roll 132 and the roll 136.

The transport medium B transported into the housing 112 is supported by transporting and holding rollers 138 and is fed onto a plurality of supporting and transporting rollers 142. Further, the transport medium B is held by transporting and holding rollers 144 disposed on the downstream side with the supporting and transporting rollers 142 located between the transporting and holding rollers 138 and the transporting and holding rollers 144. In this state, the transport medium B is subjected to scan transport by the supporting and transporting rollers 142 and is fed out from the light shielding door 116. An image recording section 150 is disposed over the supporting and transporting rollers 142 at an opposing position with the transport medium B placed therebetween. Thus a scanning and transporting section 130 is formed by the feed roll 132, the takeup roll 136, the transport rollers 134, the transporting and holding rollers 138 and 144, and the supporting and transporting rollers 142. The plurality of supporting and transporting rollers 142 are supported by a pressing unit 146, and this pressing unit 146 is movable in a direction in which it is brought into close proximity with or moved away from head units 152 of the image recording section 150 by an unillustrated drive mechanism.

A recording medium supplying unit 120 is disposed upstream of the transport rollers 134. A sheet-like recording medium S1 is fed out from the recording medium supplying unit 120, is held onto the transport medium B by an adsorbing unit (electrostatic adsorption, adhesive, or the like), and moves in the scanning and transporting section 130 to effect image recording. The recording medium S1 which is fed out from the light shielding door 116 of the scanning and transporting section 130 is peeled off the transport medium B by a recording medium separating unit 160. The recording medium separating unit 160 has electrostatic adsorptive or adhesive rollers 161 and a guide plate 162 so as to peel off and store the recording medium S1. It should be noted that the recording medium separating unit 160 may be provided with a peeling pawl disposed on the downstream side of the light shielding door 116, and a leading end of the peeling pawl may be arranged to prompt the peeling off of the sheet-like recording medium S1. Additionally, in the case where the recording medium is a seal, an arrangement may be provided to perform dies cutting with respect to only a seal portion.

With respect to the transport medium S1 being held and transported on the transport medium B by the supporting and transporting rollers 142, the image recording section 150 performs ink-jet image recording scanning and irradiation with and fixation by active energy rays (ultraviolet light in this embodiment). In terms of the configuration, an ink-jet head 54 and an active-energy-ray irradiating portion 158 are disposed in a head unit 152, and a head driver 156 is connected thereto.

Figure 6:
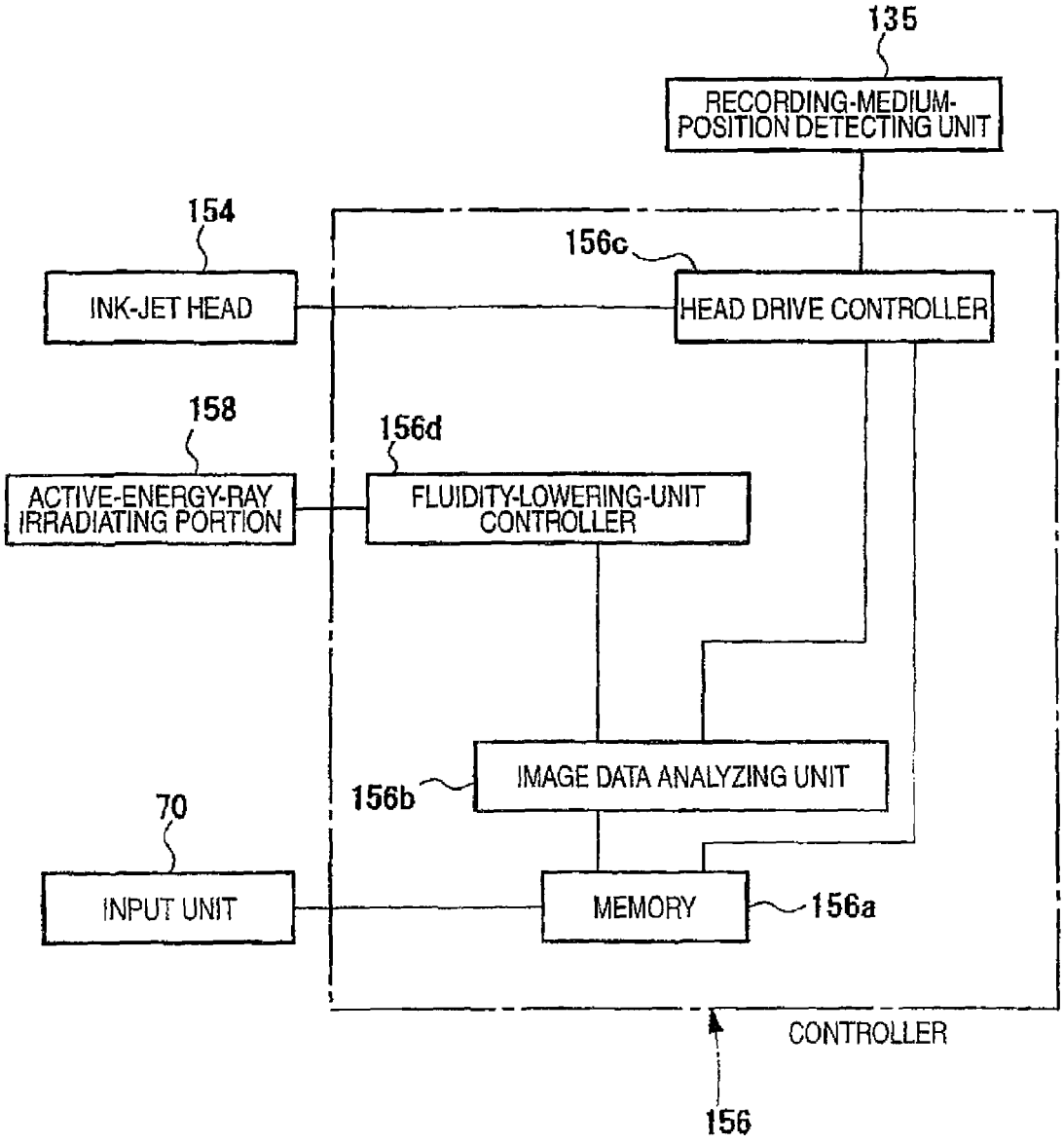
FIG. 6 is a block diagram of a controller for controlling the ink-jet recording apparatus shown in FIG. 5.
Figure 7:
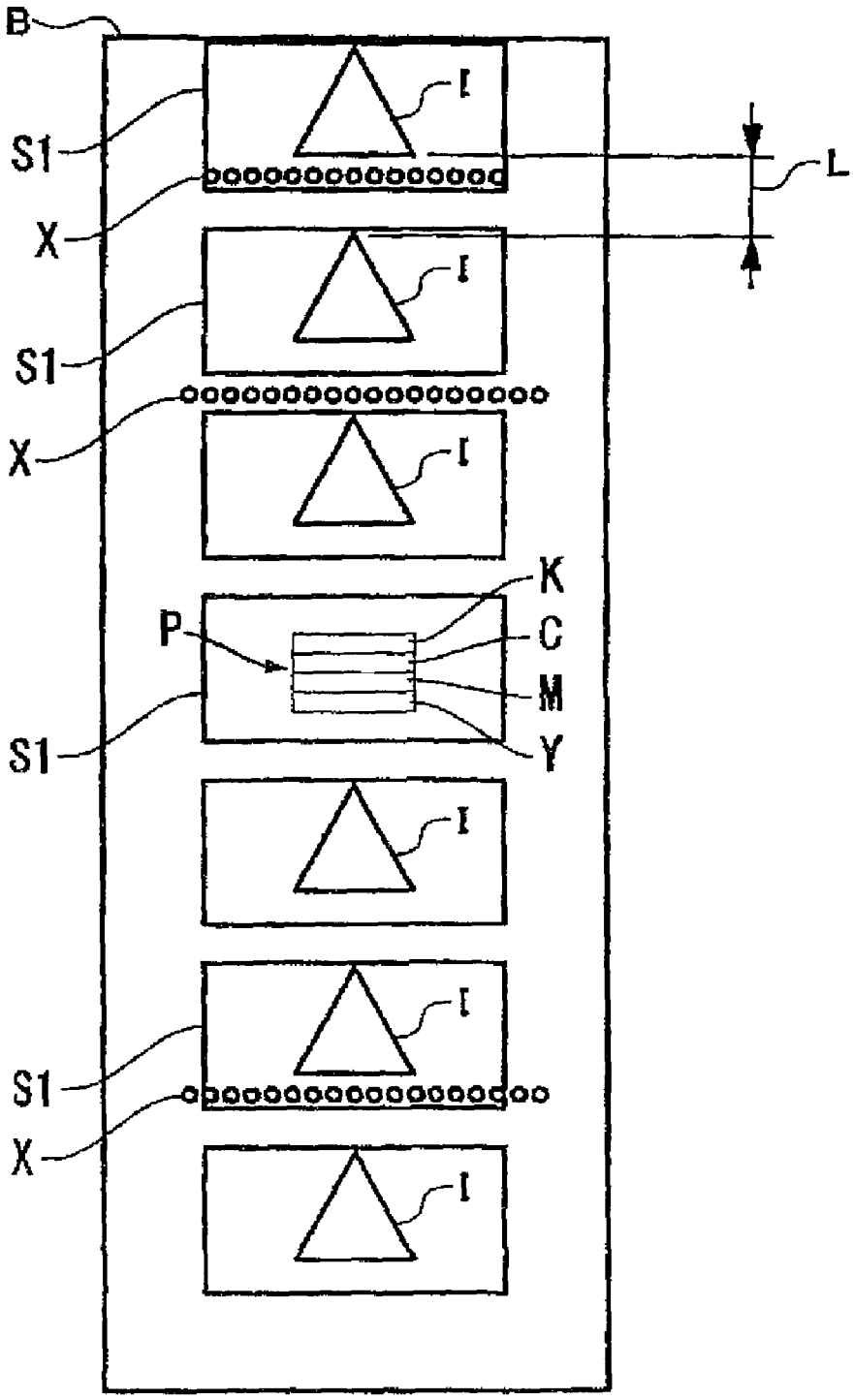
FIG. 7 is a plan view of the recording medium after printing in the ink-jet recording apparatus shown in FIG. 5.

FIG. 6 is a block diagram of a controller for controlling the ink-jet recording apparatus shown in FIG. 5, and FIG. 7 is a plan view of the recording medium after printing in the ink-jet recording apparatus shown in FIG. 5.

As shown in FIG. 6, the head driver 156 is comprised of a memory 156*a* for storing recording image-data for discharging ink by the ink-jet head 154; an image data analyzing unit 156*b* for analyzing the shape of the image I from the memory 156*a* to specify an image position on the sheet-like recording medium S1 and a position where the image is absent (non-image position); a head drive controller 156*c* for controlling the discharge from the ink-jet head 154 upon receiving in-apparatus position information of the sheet-like recording medium S1, the recording image data from the memory 156*a*, and the data analyzed by the image data analyzing unit 156*b*; and an ink-fluidity-lowering-unit controller 156*d* for controlling an ink fluidity lowering unit (the active-energy-ray irradiating portion in this embodiment) at the non-image position on the basis of the shape analyzed by the image data analyzing unit 156*b*.

It should be noted that, as for the position detection of the sheet-like recording medium S1, the detection is carried out by the recording-medium-position detecting unit 135 on the basis of such as a feeding timing of the feed roll 132 or a nipping timing of the transporting and holding rollers 138. Or, optical sensor may be provided near the transport rollers 134 to detect the sheet-like recording medium S1 based on the output of the sensor.

In addition, the recording image data stored in the memory 156*a* can be inputted from the input unit 70 of a computer or the like (not shown) connected to the ink-jet recording apparatus 100.

Next, referring to FIG. 7, a description will be given of the operation in the image recording section 150. In the image recording section 150, in this embodiment, with respect to the sheet-like recording medium S1 transported to the position of the image recording section 150, the ink-jet head 154 under control by the head drive controller 156*c* effects image recording on the basis of the recording image data (in this case, data for labeling) stored in the memory 156*a*, as described above. The ink adhering to the recording medium S1 is immediately irradiated with active energy rays by the active-energy-ray irradiating portion 158 and is cured. Although in this embodiment a single image I is formed on one recording medium S1, an arrangement may be provided to record a plurality of images thereon.

Meanwhile, on the basis of the recording image data stored in the memory 156*a*, the image data analyzing unit 156*b* specifies the range L free of image recording over the entire length of the ink-jet head 154 between the images I on the sheet-like recording medium S1. The head drive controller 156*c*, while confirming the transport position of the sheet-like recording medium S1, controls the ink-jet head 154 so as to discharge the ink in this specified range L as the maintenance discharge X. In this case, the discharge is preferably effected at a position on the recording medium S1 where an image is absent, but the discharge may be effected onto the transport medium B.

By virtue of such processing, it is possible to provide the maintenance discharge X in the full-line head system without needing to execute structural change such as the movement of the head or the movement of the recording material transport passage and, hence, without the occurrence of a deviation of reference positions of the respective constituent members of the apparatus. Further, in order to stop the flow of the ink in this maintenance discharge, the fluidity-lowering-unit controller 156*d* controls the irradiation of active energy rays from the active-energy-ray irradiating portion 158 on the basis of the range L free of image recording specified by the image data analyzing unit 156*b*.

It should be noted that the discharge of the ink in the range L free of image recording need not be effected over the entire range L free of the image, and may be effected intermittently or at random. At this time, the image data analyzing unit 156*b* selects the ink jet head 154 (including the specification of the discharge nozzles) which has not been discharging for a predetermined fixed time duration within a period when the probability of occurrence of faulty discharge is low, and transmits that information to the head drive controller 156*c*. The head drive controller 156*c* provides control for discharging the ink in the range L free of image recording by using only that ink-jet head 154.

Through such a method, it is possible to prevent the occurrence of faulty discharge from the nozzles.

In addition, the head drive controller 156*c* is capable of effecting control for selecting (including the specification of the discharge nozzles) in the image data analyzing unit 156*b* the ink-jet head 154 where faulty discharge has occurred and which has been detected by the unillustrated ink-jet faulty-discharge detector referred to in the first embodiment as well, and for causing the ink to be discharged in the range L free of image recording speedily after the occurrence of faulty discharge by using only that ink-jet head 154. Accordingly, it is possible to execute maintenance while suppressing unnecessary consumption of the ink.

Furthermore, it is also possible to allow the sheet of the recording medium S1 for maintenance to flow during the transport of the recording medium S1 for effecting image recording. In this case, a setting from the input unit 70 to the image data analyzing unit 156*b* is required.

In addition, the discharge onto such a recording medium S1 for maintenance may be arranged to record the inspection pattern P. This arrangement is shown in the above-described second embodiment.

It should be noted that the ink-jet recording method and the ink-jet recording apparatus in accordance with the invention are not limited to the foregoing embodiments, and modifications, improvements, and the like may be made, as required.

The "active energy rays" as used in the present invention is not particularly limited as long as its irradiation can impart energy capable of generating an initiation species in the ink composition, and widely includes α-ray, γ-ray, X-ray, ultraviolet ray, visible ray, electron beam and the like. Among these, in view of curing sensitivity and easy availability of the apparatus, ultraviolet ray and electron beam are preferred, and ultraviolet ray is more preferred. Accordingly, the ink composition for use in the present invention is preferably an ink composition which can be cured by the irradiation of ultraviolet ray.

In the ink-jet recording apparatus of the present invention, the peak wavelength of active energy rays varies depending on the absorption characteristics of the sensitizing dye in the ink composition but is suitably, for example, from 200 to 600 nm, preferably from 300 to 450 nm, more preferably from 350 to 450 nm Also, the (a) electron transfer-type initiation system of the ink composition for use in the present invention exhibits sufficiently high sensitivity even for low-output active energy rays. Accordingly, the output of the active energy rays used as the irradiation energy is suitably, for example, 2,000 mJ/cm$^2$ or less, preferably from 10 to 2,000 mJ/cm$^2$, more preferably from 20 to 1,000 mJ/cm$^2$, still more preferably from 50 to 800 mJ/cm$^2$. Also, the active energy rays are suitably irradiated at an exposure surface illuminance (a maximum illuminance on the recording medium surface) of, for example, from 10 to 2,000 mW/cm$^2$, preferably from 20 to 1,000 mW/cm$^2$.

Particularly, in the ink-jet recording apparatus of the present invention, the active energy rays are preferably irradiated from a light-emitting diode which can generate an ultraviolet ray having an emission wavelength peak of 390 to 420 nm and giving a maximum illuminance of 10 to 1,000 mW/cm$^2$ on the recording medium surface.

Also, in the ink-jet recording apparatus of the present invention, the active energy rays are suitably irradiated to the ink composition ejected on a recording medium, for example, for 0.01 to 120 seconds, preferably from 0.1 to 90 seconds.

Furthermore, in the ink-jet recording apparatus of the present invention, it is preferred that the ink composition is heated to a fixed temperature and the time from the landing of ink composition on a recording medium to the irradiation of active energy rays is set to 0.01 to 0.5 seconds, preferably from 0.02 to 0.3 seconds, more preferably from 0.03 to 0.15 seconds. By virtue of controlling the time from the landing of ink composition on a recording medium to the irradiation of active energy rays to such a very short time, the ink composition landed can be prevented from bleeding before curing.

For obtaining a color image by using the ink-jet recording apparatus of the present invention, the colors are preferably superposed in the color value order from lower to higher. When superposed in such an order, the active energy rays can readily reach the ink in the lower part and this can be expected to yield good curing sensitivity, reduction of residual monomer, decrease of odor and enhancement of adhesive property. As for the irradiation of active energy rays, all colors may be ejected and en bloc exposed, but exposure is preferably performed every each color in view of accelerating the curing.

As described above, in the case of active energy ray-curable ink like the ink composition of the present invention, the ink composition ejected is preferably kept at a constant temperature and therefore, the temperature in the region from the ink supply tank to the ink-jet head portion is preferably controlled by heat insulation and heating. Also, the head unit is preferably heated by thermally shielding or insulating the apparatus body so as not to receive an effect from the temperature of outer air. In order to shorten the printer start-up time necessary for heating or reduce the loss of heat energy, in combination with thermal insulation from other sites, the heat capacity of the entire heating unit is preferably made small.

As for the active energy source, a mercury lamp, a gas/solid laser and the like are principally utilized and for the ultraviolet curable-type ink-jet, a mercury lamp and a metal halide lamp are widely known. Furthermore, replacement by a GaN-based semiconductor ultraviolet light-emitting device is industrially and environmentally very useful. In addition, LED (UV-LED) and LD (UV-LD) are compact, long-lived, highly efficient and low costing and are promising as a radiation source for active energy ray-curable-type ink-jet.

As described above, a light-emitting diode (LED) and a laser diode (LD) can be used as the active energy source. In particular, when an ultraviolet source is necessary, an ultraviolet LED or an ultraviolet LD can be used. For example, an ultraviolet LED of which main emission spectrum has a wavelength between 365 nm and 420 nm is commercially available from Nichia Corp. Also, when a further shorter wavelength is required, an LED capable of emitting active energy rays having a primary emission between 300 nm and 370 nm is disclosed in U.S. Pat. No. 6,084,250. Other ultraviolet LEDs are also available, and radiations in different ultraviolet bands may be irradiated. The active energy source for use in the present invention is preferably UV-LED, more preferably UV-LED having a peak wavelength in the region of 350 to 420 nm.

Although in the foregoing embodiments the lowering of fluidity by the active-energy-ray irradiating unit is carried out, it is also possible to adopt the introduction of a material for heating, cooling, and the lowering of fluidity instead of or in addition to the active energy rays.

Heating includes a method in which the temperature of the obverse surface of the recording medium or the reverse surface of the recording medium is increased by warm water, a heater, or light. Also, cool water, air cooling, a Peltier elements or the like may be used for cooling.

In addition, in the introduction of the material for lowering the fluidity, a pair of compounds which either produces an aggregate or increases in viscosity by reaction on mixing can be respectively contained separately as a functional material and a fluidity lowering material. The pair of compounds has a characteristic of speedily forming an aggregate or speedily increasing the viscosity of a liquid, thereby making it possible to more effectively control the coalescence between mutually adjacent droplets.

As reaction examples of the aforementioned pair of compounds, it is possible to cite the acid-base reaction, the hydrogen bond reaction based on a carboxylic acid and an amide group-containing compound, cross-linking reaction typified by a boronic acid and a diol, reaction based on electrostatic interaction between a cation and an anion, and the like.

In addition, the lowering of fluidity based on the introduction of an interfacial active agent-containing material and/or a high viscosity material is also effective. The aforementioned fluidity lowering material is introduced either before or after the discharge and pressurization purge by ink-jet discharging, coating, or spraying.

[Recording Medium]

The recording medium to which the ink composition of the present invention can be applied is not particularly limited and normal paper sheets such as non-coated paper and coated paper, and various non-absorptive resin materials and resin films shaped therefrom, which are used in so-called soft packaging, may be used. Examples of various plastic films include PET film, OPS film, OPP film, ONy film, PVC film, PE film and TAC film. Other examples of the plastic usable as the recording medium material include polycarbonate, acrylic resin, ABS, polyacetal, PVA and rubbers. Furthermore, metals and glasses may also be used as the recording medium.

In the ink composition of the present invention, when a material less causing heat shrinkage at curing is selected, excellent adhesive property is obtained between the cured ink composition and the recording medium and this is advantageous in that a high-definition image can be formed even on a film susceptible to curling or deformation due to, for example, curing shrinkage of ink or heat generation at the curing reaction, such as PET film, OPS film, OPP film, ONy film and PVC film which are thermally shrinkable.

The constituent components for use in the ink composition usable in the present invention are described below in sequence.

[Ink Composition]

The ink composition for use in the present invention is an ink composition capable of being cured by the irradiation of active energy, and examples thereof include a cationic polymerization-type ink composition, a radical polymerization-type ink composition and an aqueous ink composition. These compositions are described in detail below.

(Cationic Polymerization-Type Ink Composition)

The cationic polymerization-type ink composition contains (a) a cationic polymerizable compound and (b) a compound capable of generating an acid upon irradiation with active energy and if desired, may further contain a colorant, an ultraviolet absorbent, a sensitizer, an antioxidant, a discoloration inhibitor, electrically conducting salts, a solvent, a polymer compound, a surfactant and the like.

The constituent components used in the cationic polymerization-type ink composition are described below in sequence.

[(a) Cationic Polymerizable Compound]

The (a) cationic polymerizable compound for use in the present invention is not particularly limited as long as it is a compound capable of being cured by causing a polymerization reaction using an acid generated from the (b) compound capable of generating an acid upon irradiation with active energy, and various known cationic polymerizable monomers known as a photo-cationic polymerizable monomer may be used. Examples of the cationic polymerizable monomer include epoxy compounds, vinyl ether compounds and oxetane compounds described in JP-A-6-9714, JP-A-2001-31892, JP-A-2001-40068, JP-A-2001-55507, JP-A-2001-310938, JP-A-2001-310937 and JP-A-2001-220526.

Examples of the epoxy compound include an aromatic epoxide, an alicyclic epoxide and an aliphatic epoxide.

The aromatic epoxide includes a di- or polyglycidyl ether produced by the reaction of a polyhydric phenol having at least one aromatic nucleus or an alkylene oxide adduct thereof with epichlorohydrin. Examples thereof include a di- or polyglycidyl ether of bisphenol A or an alkylene oxide adduct thereof, a di- or polyglycidyl ether of hydrogenated bisphenol A or an alkylene oxide adduct thereof, and a novolak-type epoxy resin. Examples of the alkylene oxide include an ethylene oxide and a propylene oxide.

As for the alicyclic epoxide, a cyclohexene oxide- or cyclopentene oxide-containing compound obtained by epoxidizing a compound having at least one cycloalkene ring such as cyclohexene or cyclopentene ring with an appropriate oxidizing agent such as hydrogen peroxide and peracid is preferred.

Examples of the aliphatic epoxide include a di- or polyglycidyl ether of an aliphatic polyhydric alcohol or an alkylene oxide adduct thereof. Representative examples thereof include a diglycidyl ether of an alkylene glycol, such as diglycidyl ether of ethylene glycol, diglycidyl ether of propylene glycol, and diglycidyl ether of 1,6-hexanediol; a polyglycidyl ether of a polyhydric alcohol, such as di- or triglycidyl ether of glycerin or an alkylene oxide adduct thereof; and a diglycidyl ether of a polyalkylene glycol, as represented by a diglycidyl ether of a polyethylene glycol or an alkylene oxide adduct thereof, and a diglycidyl ether of a polypropylene glycol or an alkylene oxide adduct thereof. Here, examples of the alkylene oxide include an ethylene oxide and a propylene oxide.

The epoxy compound may be monofunctional or polyfunctional.

Examples of the monofunctional epoxy compound which can be used in the present invention include phenyl glycidyl ether, p-tert-butylphenyl glycidyl ether, butyl glycidyl ether, 2-ethylhexyl glycidyl ether, allyl glycidyl ether, 1,2-butylene oxide, 1,3-butadiene monoxide, 1,2-epoxydodecane, epichlorohydrin, 1,2-epoxydecane, styrene oxide, cyclohexene oxide, 3-methacryloyloxymethylcyclohexene oxide, 3-acryloyloxymethylcyclohexene oxide and 3-vinylcyclohexene oxide.

Examples of the polyfunctional epoxy compound include bisphenol A diglycidyl ether, bisphenol F diglycidyl ether, bisphenol S diglycidyl ether, brominated bisphenol A diglycidyl ether, brominated bisphenol F diglycidyl ether, brominated bisphenol S diglycidyl ether, epoxy novolak resin, hydrogenated bisphenol A diglycidyl ether, hydrogenated bisphenol F diglycidyl ether, hydrogenated bisphenol S diglycidyl ether, 3,4-epoxycyclohexylmethyl-3',4'-epoxycyclohexane carboxylate, 2-(3,4-epoxy-cyclohexyl-5,5-spiro-3,4-epoxy)cyclohexane-meta-dioxane, bis(3,4-epoxycyclohexylmethyl)adipate, vinylcyclohexene oxide, 4-vinylepoxycyclohexane, bis(3,4-epoxy-6-methyl-cyclohexylmethyl)adipate, 3,4-epoxy-6-methylcyclohexyl-3',4'- epoxy-6'-methylcyclohexane carboxylate, methylenebis(3,4-epoxycyclohexane), dicyclopentadiene diepoxide, di(3,4-epoxycyclohexylmethyl)ether of ethylene glycol, ethylenebis(3,4-epoxycyclohexane carboxylate), dioctyl epoxyhexahydrophthalate, di-2-ethylhexyl epoxyhexahydrophthalate, 1,4-butanediol diglycidyl ether, 1,6-hexanediol diglycidyl ether, glycerin triglycidyl ether, trimethylolpropane triglycidyl ether, polyethylene glycol diglycidyl ether, polypropylene glycol diglycidyl ethers, 1,1,3-tetradecadiene dioxide, limonene dioxide, 1,2,7,8-diepoxyoctane and 1,2,5,6-diepoxycyclooctane.

Among these epoxy compounds, an aromatic epoxide and an alicyclic epoxide are preferred in view of excellent curing rate, and an alicyclic epoxide is more preferred.

Examples of the vinyl ether compound include a di- or trivinyl ether compound such as ethylene glycol divinyl ether, diethylene glycol divinyl ether, triethylene glycol divinyl ether, propylene glycol divinyl ether, dipropylene glycol divinyl ether, butanediol divinyl ether, hexanediol divinyl ether, cyclohexanedimethanol divinyl ether and trimethylolpropane trivinyl ether; and a monovinyl ether compound such as ethyl vinyl ether, n-butyl vinyl ether, isobutyl vinyl ether, octadecyl vinyl ether, cyclohexyl vinyl ether, hydroxybutyl vinyl ether, 2-ethylhexyl vinyl ether, cyclohexanedimethanol monovinyl ether, n-propyl vinyl ether, isopropyl vinyl ether, isopropenyl ether-O-propylene carbonate, dodecyl vinyl ether, diethylene glycol monovinyl ether and octadecyl vinyl ether.

The vinyl ether compound may be monofunctional or polyfunctional.

Specifically, examples of the monofunctional vinyl ether include methyl vinyl ether, ethyl vinyl ether, propyl vinyl ether, n-butyl vinyl ether, tert-butyl vinyl ether, 2-ethylhexyl vinyl ether, n-nonyl vinyl ether, lauryl vinyl ether, cyclohexyl vinyl ether, cyclohexylmethyl vinyl ether, 4-methylcyclohexylmethyl vinyl ether, benzyl vinyl ether, dicyclopentenyl vinyl ether, 2-dicyclopentenoxyethyl vinyl ether, methoxyethyl vinyl ether, ethoxyethyl vinyl ether, butoxyethyl vinyl ether, methoxyethoxyethyl vinyl ether, ethoxyethoxyethyl vinyl ether, methoxypolyethylene glycol vinyl ether, tetrahydrofurfuryl vinyl ether, 2-hydroxyethyl vinyl ether, 2-hydroxypropyl vinyl ether, 4-hydroxybutyl vinyl ether, 4-hydroxymethylcyclohexylmethyl vinyl ether, diethylene glycol monovinyl ether, polyethylene glycol vinyl ether, chloroethyl vinyl ether, chlorobutyl vinyl ether, chloroethoxyethyl vinyl ether, phenylethyl vinyl ether and phenoxypolyethylene glycol vinyl ether.

Examples of the polyfunctional vinyl ether include divinyl ethers such as ethylene glycol divinyl ether, diethylene glycol divinyl ether, polyethylene glycol divinyl ether, propylene glycol divinyl ether, butylene glycol divinyl ether, hexanediol divinyl ether, bisphenol A alkylene oxide divinyl ether and bisphenol F alkylene oxide divinyl ether; and polyfunctional vinyl ethers such as trimethylolethane trivinyl ether, trimethylolpropane trivinyl ether, ditrimethylolpropane tetravinyl ether, glycerin trivinyl ether, pentaerythritol tetravinyl ether, dipentaerythritol pentavinyl ether, dipentaerythritol hexavinyl ether, ethylene oxide-added trimethylolpropane trivinyl ether, propylene oxide-added trimethylolpropane trivinyl ether, ethylene oxide-added ditrimethylolpropane tetravinyl ether, propylene oxide-added ditrimethylolpropane tetravinyl ether, ethylene oxide-added pentaerythritol tetravinyl ether, propylene oxide-added pentaerythritol tetravinyl ether, ethylene oxide-added dipentaerythritol hexavinyl ether and propylene oxide-added dipentaerythritol hexavinyl ether.

As for the vinyl ether compound, a di- or trivinyl ether compound is preferred in view of curing property, adhesion to recording medium, surface hardness of image formed, or the like, and a divinyl ether compound is more preferred.

The oxetane compound as referred to in the present invention indicates a compound having an oxetane ring, and known oxetane compounds described, for example, in JP-A-2001-220526, JP-A-2001-310937 and JP-A-2003-341217 may be arbitrarily selected and used.

The compound having an oxetane ring, which can be used in the ink composition of the present invention, is preferably a compound having from one to four oxetane rings in the structure thereof. When such a compound is used, the viscosity of the ink composition can be easily maintained in the range allowing for good handling, and high adhesion can be obtained between the ink composition after curing and the recording medium.

Such a compound having an oxetane ring is described in detail in paragraphs [0021] to [0084] of JP-A-2003-341217, and compounds described therein can be suitably used also in the present invention.

Out of the oxetane compounds for use in the present invention, a compound having one oxetane ring is preferably used in view of viscosity and tackiness of the ink composition.

In the ink composition of the present invention, one of these cationic polymerizable compounds may be used alone, or two or more species thereof may be used in combination, but from the standpoint of effectively controlling the shrinkage on curing the ink, at least one compound selected from oxetane compounds and epoxy compounds is preferably used in combination with a vinyl ether compound.

The content of the (a) cationic polymerizable compound in the ink composition is suitably from 10 to 95 mass %, preferably from 30 to 90 mass %, more preferably from 50 to 85 mass %, based on the entire solid content of the composition.

[(b) Compound Capable of Generating an Acid upon Irradiation with Active Energy]

The ink composition of the present invention contains a compound capable of generating an acid upon irradiation with active energy (hereinafter appropriately referred to as a "photoacid generator").

The photoacid generator which can be used in the present invention may be appropriately selected from compounds capable of generating an acid upon irradiation with light (ultraviolet ray or far ultraviolet ray of 400 to 200 nm, preferably g-ray, h-ray, i-ray or KrF excimer laser light), ArF excimer laser light, electron beam, X-ray, molecular beam or ion beam, which are used in a photo-cationic polymerization photoinitiator, a photo-radical polymerization photoinitiator, a photo-decolorizing agent for coloring matters, a photo-discoloring agent, a micro resist or the like.

Examples of such a photoacid generator include an onium salt which decomposes upon irradiation with active energy to generate an acid, such as diazonium salt, ammonium salt, phosphonium salt, iodonium salt, sulfonium salt, selenonium salt and arsonium salt; an organic halogen compound; an organic metal/organic halide; an o-nitrobenzyl type protective group-containing photoacid generator; a compound capable of undergoing photodecomposition to generate a sulfonic acid, as represented by imino sulfonate; a disulfone compound; a diazoketosulfone; and a diazodisulfone compound.

Furthermore, for example, oxazole derivatives and s-triazine derivatives described in paragraphs [0029] to [0030] of JP-A-2002-122994 may also be suitably used as the photoacid generator. In addition, onium salt compounds and sulfonate-based compounds described in paragraphs [0037] to

[0063] of JP-A-2002-122994 may also be suitably used as the photoacid generator in the present invention.

As for the (b) photoacid generator, one species may be used alone or two or more species may be used in combination.

The content of the (b) photoacid generator in the ink composition is preferably from 0.1 to 20 mass %, more preferably from 0.5 to 10 mass %, still more preferably from 1 to 7 mass %, based on the entire solid content of the ink composition.

[Colorant]

The ink composition of the present invention can form a visible image by adding thereto a colorant. For example, in the case of forming an image region of a lithographic printing plate, a colorant need not be necessarily added, but in view of suitability for plate inspection of the obtained lithographic printing plate, use of a colorant is also preferred.

The colorant which can be used here is not particularly limited, and various known coloring materials (pigment, dye) may be appropriately selected and used according to the usage. For example, in the case of forming an image with excellent weather resistance, a pigment is preferred. As for the dye, both a water-soluble dye and an oil-soluble dye may be used, but an oil-soluble dye is preferred.

[Pigment]

The pigment which is preferably used in the present invention is described below.

The pigment is not particularly limited and, for example, all organic and inorganic pigments generally available on the market, those obtained by dispersing a pigment in a dispersion medium such as insoluble resin, and those obtained by grafting a resin to the pigment surface may be used. In addition, those obtained by, for example, dyeing a resin particle with a dye may also be used.

Examples of such a pigment include pigments described in Seishiro Ito (compiler), *Ganryo No Jiten* (*Pigment Dictionary*), published in 2000, W. Herbst and K. Hunger, *Industrial Organic Pigments*, JP-A-2002-12607, JP-A-2002-188025, JP-A-2003-26978 and JP-A-2003-342503.

Specific examples of the organic and inorganic pigments which can be used in the present invention are as follows. Examples of the pigment which provides a yellow color include a monoazo pigment such as C.I. Pigment Yellow 1 (e.g., Fast Yellow G) and C.I. Pigment Yellow 74; a disazo pigment such as C.I. Pigment Yellow 12 (e.g., Disazo Yellow AAA) and C.I. Pigment Yellow 17; a non-benzidine-based azo pigment such as C.I. Pigment Yellow 180; an azo lake pigment such as C.I. Pigment Yellow 100 (e.g., Tartrazine Yellow Lake); a condensed azo pigment such as C.I. Pigment Yellow 95 (e.g., Condensed Azo Yellow GR); an acidic dye lake pigment such as C.I. Pigment Yellow 115 (e.g., Quinoline Yellow Lake); a basic dye lake pigment such as C.I. Pigment Yellow 18 (e.g., Thioflavine Lake); an anthraquinone-based pigment such as Flavanthrone Yellow (Y-24); an isoindolinone pigment such as Isoindolinone Yellow 3RLT (Y-110); a quinophthalone pigment such as Quinophthalone Yellow (Y-138); an isoindoline pigment such as Isoindoline Yellow (Y-139); a nitroso pigment such as C.I. Pigment Yellow 153 (e.g., Nickel Nitroso Yellow); and a metal complex salt azomethine pigment such as C.I. Pigment Yellow 117 (e.g., Copper Azomethine Yellow).

Examples of the pigment which provides a red or magenta color include a monoazo-based pigment such as C.I. Pigment Red 3 (e.g., Toluidine Red); a disazo pigment such as C.I. Pigment Red 38 (e.g., Pyrazolone Red B); an azo lake pigment such as C.I. Pigment Red 53:1 (e.g., Lake Red C) and C.I. Pigment Red 57:1 (Brilliant Carmine 6B); a condensed azo pigment such as C.I. Pigment Red 144 (e.g., Condensed Azo Red BR); an acidic dye lake pigment such as C.I. Pigment Red 174 (e.g., Phloxine B Lake); a basic dye lake pigment such as C.I. Pigment Red 81 (e.g., Rhodamine 6G' Lake); an anthraquinone-based pigment such as C.I. Pigment Red 177 (e.g., Dianthraquinonyl Red); a thioindigo pigment such as C.I. Pigment Red 88 (e.g., Thioindigo Bordeaux); a perinone pigment such as C.I. Pigment Red 194 (e.g., Perinone Red); a perylene pigment such as C.I. Pigment Red 149 (e.g., Perylene Scarlet); a quinacridone pigment such as C.I. Pigment Violet 19 (unsubstituted quinacridone) and C.I. Pigment Red 122 (e.g., Quinacridone Magenta); an isoindolinone pigment such as C.I. Pigment Red 180 (e.g., Isoindolinone Red 2BLT); and an alizarin lake pigment such as C.I. Pigment Red 83 (e.g., Madder Lake).

Examples of the pigment which provides a blue or cyan color include a disazo-based pigment such as C.I. Pigment Blue 25 (e.g., Dianisidine Blue); a phthalocyanine pigment such as C.I. Pigment Blue 15 (e.g., Phthalocyanine Blue) ; an acidic dye lake pigment such as C.I. Pigment Blue 24 (e.g., Peacock Blue Lake); a basic dye lake pigment such as C.I. Pigment Blue 1 (e.g., Victoria Pure Blue BO Lake); an anthraquinone-based pigment such as C.I. Pigment Blue 60 (e.g., Indanthrone Blue); and an alkali blue pigment such as C.I. Pigment Blue 18 (Alkali Blue V-5:1).

Examples of the pigment which provides a green color include a phthalocyanine pigment such as C.I. Pigment Green 7 (Phthalocyanine Green) and C.I. Pigment Green 36 (Phthalocyanine Green); and an azo metal complex pigment such as C.I. Pigment Green 8 (Nitroso Green).

Examples of the pigment which provides an orange color include an isoindoline-based pigment such as C.I. Pigment Orange 66 (Isoindoline Orange); and an anthraquinone-based pigment such as C.I. Pigment Orange 51 (Dichloropyranthrone Orange).

Examples of the pigment which provides a black color include carbon black, titanium black and aniline black.

Specific examples of the white pigment which can be used include basic lead carbonate ($2PbCO_3Pb(OH)_2$, so-called "silver white"), zinc oxide (ZnO, so-called "zinc white"), titanium oxide ($TiO_2$, so-called "titanium white"), strontium titanate ($SrTiO_3$, so-called "titanium strontium white").

Here, titanium oxide has a low specific gravity and a high refractive index and is chemically and physically stable as compared with other white pigments and therefore, this pigment ensures that the masking power and coloring power as a pigment are high and the durability against acid, alkali and other environments is excellent. Because of this, titanium oxide is preferably used as the white pigment. As a matter of course, other white pigments (may also be a white pigment other than those described above) may be used, if desired.

The pigment may be dispersed by using a dispersing device such as ball mill, sand mill, attritor, roll mill, jet mill, homogenizer, paint shaker, kneader, agitator, Henschel mixer, colloid mill, ultrasonic-homogenizer, pearl mill and wet jet mill.

When dispersing the pigment, a dispersant may also be added. Examples of the dispersant include a hydroxyl group-containing carboxylic acid ester, a salt of long-chain polyaminoamide with high molecular weight acid ester, a salt of high molecular weight polycarboxylic acid, a high molecular weight unsaturated acid ester, a polymer copolymerization product, a modified polyacrylate, an aliphatic polyvalent carboxylic acid, a naphthalenesulfonic acid formalin condensate, a polyoxyethylene alkylphosphoric ester and a pigment derivative. A commercially available polymer dispersant such as Solsperse Series of Zeneca Ltd. may also be preferably used.

In addition, a synergist according to various pigments may be used as a dispersion aid. The dispersant or dispersion aid is preferably added in an amount of 1 to 50 parts by mass per 100 parts by mass of the pigment.

In the ink composition, a solvent may be added as a dispersion medium for various components such as pigment, or the (a) cationic polymerizable compound which is a low molecular weight component may be used as a dispersion medium without using a solvent. However, since the ink composition of the present invention is an active energy-curable ink and the ink is applied onto a recording medium and then cured, the ink composition is preferably solvent-free. This is because when a solvent remains in the cured ink image, the solvent resistance may deteriorate or the residual solvent may cause a problem of VOC (volatile organic compound). From such a standpoint, the (a) cationic polymerizable compound is preferably used as the dispersion medium. Above all, in view of dispersion suitability or enhancement of handling property of the ink composition, a cationic polymerizable monomer having a lowest viscosity is preferably selected.

The average particle diameter of the pigment is preferably from 0.02 to 4 μm, more preferably from 0.02 to 2 μm, still more preferably from 0.02 to 1.0 μm.

The pigment, dispersant, dispersion medium and dispersion or filtration conditions are selected or set so that the pigment particle can have an average particle diameter in the above-described preferred range. By this control of the particle diameter, clogging of the head nozzle can be suppressed and the storage stability, transparency and curing sensitivity of ink can be maintained.

[Dye]

The dye for use in the present invention is preferably an oil-soluble dye. Specifically, the oil-soluble dye means a dye having a solubility in water at 25° C. (mass of the coloring matter dissolved in 100 g of water) of 1 g or less. The solubility is preferably 0.5 g or less, more preferably 0.1 g or less. Accordingly, a so-called water-insoluble oil-soluble dye is preferably used.

As regards the dye for use in the present invention, it is also preferred to introduce an oil-solubilizing group into the mother nucleus of the above-described dye for the purpose of dissolving a necessary amount of dye in the ink composition.

Examples of the oil-solubilizing group include a long-chain or branched alkyl group, a long-chain or branched alkoxy group, a long-chain or branched alkylthio group, a long-chain or branched alkylsulfonyl group, a long-chain or branched acyloxy group, a long-chain or branched alkoxycarbonyl group, a long-chain or branched acyl group, a long-chain or branched acylamino group, a long-chain or branched alkylsulfonylamino group, a long-chain or branched alkylaminosulfonyl group; and an aryl group, an aryloxy group, an aryloxycarbonyl group, an arylcarbonyloxy group, an arylaminocarbonyl group, an arylaminosulfonyl group and an arylsulfonylamino group, each containing the above-described long-chain or branched substituent.

Furthermore, the dye may be obtained from a water-soluble dye having a carboxyl acid or a sulfonic acid through conversion into an oil-solubilizing group, that is, an alkoxycarbonyl group, an aryloxycarbonyl group, an alkylaminosulfonyl group or an arylaminosulfonyl group, by using a long-chain or branched alcohol, an amine, a phenol or an aniline derivative.

The oil-soluble-dye preferably has a melting point of 200° C. or less, more preferably 150° C. or less, still more preferably 100° C. By using an oil-soluble dye having a low melting point, crystal precipitation of the coloring matter in the ink composition is suppressed and the ink composition comes to have good storage stability.

Furthermore, for the purpose of improving resistance against fading, particularly against an oxidative substance such as ozone, or enhancing the curing property, the oxidation potential is preferably noble (high). For this reason, the oil-soluble dye for use in the present invention preferably has an oxidation potential of 1.0 V (vs SCE) or more. A higher oxidation potential is preferred, and the oxidation potential is more preferably 1.1 V (vs SCE) or more, still more preferably 1.15 V (vs SCE) or more.

As for the dye of yellow color, compounds having a structure represented by formula (Y-I) of JP-A-2004-250483 are preferred.

Dyes represented by formulae (Y-II) to (Y-IV) described in paragraph [0034] of JP-A-2004-250483 are more preferred. Specific examples thereof include compounds described in paragraphs [0060] to [0071] of JP-A-2004-250483. Incidentally, the oil-soluble dye of formula (Y-I) described in the patent publication above may be used not only for yellow ink but also for ink of any color, such as black ink and red ink.

As for the dye of magenta color, compounds having a structure represented by formula (3) or (4) described in JP-A-2002-114930 are preferred. Specific examples thereof include the compounds described in paragraphs [0054] to [0073] of JP-A-2002-114930.

Azo dyes represented by formulae (M-1) to (M-2) described in paragraphs [0084] to [0122] of JP-A-2002-121414 are more preferred, and specific examples thereof include the compounds described in paragraphs [0123] to [0132] of JP-A-2002-121414. Incidentally, the oil-soluble dyes of formulae (3), (4) and (M-1) to (M-2) described in these patent publications may be used not only for magenta ink but also for ink of any color, such as black ink and red ink.

As for the dye of cyan color, dyes represented by formulae (I) to (IV) of JP-A-2001-81547 and dyes represented by formulae (IV-1) to (IV-4) described in paragraphs [0063] to [0078] of JP-A-2002-121414 are preferred. Specific examples thereof include the compounds described in paragraphs [0052] to [0066] of JP-A-2001-181547 and the compounds described in paragraphs [0079] to [0081] of JP-A-2002-121414.

Phthalocyanine dyes represented by formulae (C-I) and (C-II) described in paragraphs [0133] to [0196] of JP-A-2002-121414 are more preferred, and the phthalocyanine dye represented by formula (C-II) is still more preferred. Specific examples thereof include the compounds described in paragraphs [0198] to [0201] of JP-A-2002-121414. Incidentally, the oil-soluble dyes of formulae (I) to (IV), (IV-1) to (IV-4) (C-I) and (C-II) may be used not only for cyan ink but also for ink of any color, such as black ink and green ink.

Such a colorant is preferably added in an amount of, in terms of the solid content, from 1 to 20 mass %, more preferably from 2 to 10 mass %, based on the ink composition.

In the ink composition of the present invention, in addition to the above-described essential components, various additives may be used in combination according to the purpose. These arbitrary components are described below.

[Ultraviolet Absorbent]

In the present invention, an ultraviolet absorbent may be used from the standpoint of giving an image enhanced in the weather resistance and prevented from fading.

Examples of the ultraviolet absorbent include benzotriazole-based compounds described in JP-A-58-185677, JP-A-61-190537, JP-A-2-782, JP-A-5-197075 and JP-A-9-34057;

benzophenone-based compounds described in JP-A-46-2784, JP-A-5-194483 and U.S. Pat. No. 3,214,463; cinnamic acid-based compounds described in JP-B-48-30492 (the term "JP-B" as used herein means an "examined Japanese patent application"), JP-B-56-21141 and JP-A-10-88106; triazine-based compounds described in JP-A-4-298503, JP-A-8-53427, JP-A-8-239368, JP-A-10-182621 and JP-T-8-501291 (the term (the term "JP-T" as used herein means a "published Japanese translation of a PCT patent application"); compounds described in *Research Disclosure*, No. 24239; and compounds capable of absorbing ultraviolet ray to emit fluorescence, so-called fluorescent brightening agent, as represented by a stilbene-based compound and a benzoxazole-based compound.

The amount of the ultraviolet absorbent added is appropriately selected according to the purpose but is generally on the order of 0.5 to 15 mass % in terms of the solid content.

[Sensitizer]

In the ink composition of the present invention, if desired, a sensitizer may be added for the purpose of enhancing the acid generation efficiency of the photoacid generator and shifting the photosensitive wavelength to a long wavelength side. The sensitizer may be any sensitizer as long as it can sensitize the photoacid generator by an electron or energy transfer mechanism. Preferred examples thereof include an aromatic polycondensed ring compound such as anthracene, 9,10-dialkoxyanthracene, pyrene and perylene; an aromatic ketone compound such as acetophenone, benzophenone, thioxanthone and Michler's ketone; and a heterocyclic compound such as phenothiazine and N-aryloxazolidinone. The amount of the sensitizer added is appropriately selected according to the purpose but is generally from 0.01 to 1 mol %, preferably from 0.1 to 0.5 mol %, based on the photoacid generator.

[Antioxidant]

An antioxidant may be added for the purpose of enhancing the stability of the ink composition. Examples of the antioxidant include those described in EP-A-223739, EP-A-309401, EP-A-309402, EP-A-310551, EP-A-310552, EP-A-459416, German Unexamined Patent Publication No. 3435443, JP-A-54-48535, JP-A-62-262047, JP-A-63-113536, JP-A-63-163351, JP-A-2-262654, JP-A-2-71262, JP-A-3-121449, JP-A-5-61166, JP-A-5-119449, and U.S. Pat. Nos. 4,814,262 and 4,980,275.

The amount of the antioxidant added is appropriately selected according to the purpose but is generally on the order of 0.1 to 8 mass % in terms of the solid content.

[Anti-fading Agent]

In the ink composition of the present invention, various organic or metal complex-based anti-fading agents may be used. Examples of the organic anti-fading agent include hydroquinones, alkoxyphenols, dialkoxyphenols, phenols, anilines, amines, indanes, chromans, alkoxyanilines and heterocyclic compounds. Examples of the metal complex-based anti-fading agent include a nickel complex and a zinc complex, and specifically, there may be used the compounds described in patents cited in *Research Disclosure*, No. 17643, No. VII, Items I to J, ibid., No. 15162, ibid., No. 18716, page 650, left column, ibid., No. 36544, page 527, ibid., No. 307105, page 872, and ibid., No, 15162; and the compounds included in formulae of representative compounds and in examples of the compounds describe on JP-A-62-215272, pp. 127-137.

The amount of the anti-fading agent added is appropriately selected according to the purpose but is generally on the order of 0.1 to 8 mass % in terms of the solid content.

[Electrically Conducting Salts]

In the ink composition of the present invention, electrically conducting salts such as potassium thiocyanate, lithium nitrate, ammonium thiocyanate and dimethylamine hydrochloride may be added for the purpose of controlling the ejection physical property.

[Solvent]

In the ink composition of the present invention, addition of an organic solvent in an extremely small amount is also effective for the purpose of improving the adhesion to a recording medium.

Examples of the solvent include a ketone-based solvent such as acetone, methyl ethyl ketone and diethyl ketone; an alcohol-based solvent such as methanol, ethanol, 2-propanol, 1-propanol, 1-butanol and tert-butanol; a chlorine-based solvent such as chloroform and methylene chloride; an aromatic solvent such as benzene and toluene; an ester-based solvent such as ethyl acetate, butyl acetate and isopropyl acetate; an ether-based solvent such as diethyl ether, tetrahydrofuran and dioxane; and a glycol ether-based solvent such as ethylene glycol monomethyl ether and ethylene glycol dimethyl ether.

In this case, addition in the range of not causing a problem in the solvent resistance or VOC is effective, and this amount is preferably from 0.1 to 5 mass %, more preferably from 0.1 to 3 mass %, based on the entire ink composition.

[Polymer Compound]

In the ink composition of the present invention, various polymer compounds may be added for the purpose of adjusting the film physical properties. Examples of the polymer compound which can be used include an acryl-based polymer, a polyvinyl butyral resin, a polyurethane resin, a polyamide resin, a polyester resin, an epoxy resin, a phenol resin, a polycarbonate resin, a polyvinyl butyral resin, a polyvinyl formal resin, a shellac, a vinyl-based resin, an acryl-based resin, a rubber-based resin, waxes and other natural resins. Also, two or more species thereof may be used in combination. Among these, a vinyl-based copolymer obtainable by the copolymerization of an acryl-based monomer is preferred. In addition, as for the copolymerization composition of the polymer binder, a copolymer containing, as the structural unit, a "carboxyl group-containing monomer", an "alkyl methacrylate" or an "alkyl acrylate" is also preferably used.

[Surfactant]

In the ink composition of the present invention, a surfactant may also be added.

The surfactant includes those described in JP-A-62-173463 and JP-A-62-183457. Examples thereof include an anionic surfactant such as dialkylsulfosuccinates, alkylnaphthalenesulfonates and fatty acid salts; a nonionic surfactant such as polyoxyethylene alkyl ethers, polyoxyethylene alkylallyl ethers, acetylene glycols and polyoxyethylene-polyoxypropylene block copolymers; and a cationic surfactant such as alkylamine salts and quaternary ammonium salts. Incidentally, an organic fluoro compound may be used in place of the surfactant above. The organic fluoro compound is preferably hydrophobic. Examples of the organic fluoro compound include a fluorine-containing surfactant, an oily fluorine-containing compound (e.g., fluorine oil), a solid fluorine compound resin (e.g., tetrafluoroethylene resin), and those described in JP-B-57-9053 (columns 8 to 17) and JP-A-62-135826.

Other than these, for example, a leveling additive, a matting agent, waxes for adjusting the film physical properties, and a tackifier for improving adhesion to a recording medium such as polyolefin and PET, which does not inhibit the polymerization, may be added, if desired.

Specific examples of the tackifier include high molecular weight adhesive polymers described in JP-A-2001-49200, pp. 5-6 (for example, a copolymer comprising an ester of a (meth)acrylic acid and an alcohol containing an alkyl group having a carbon number of 1 to 20, an ester of a (meth)acrylic acid and an alicyclic alcohol having a carbon number of 3 to 14, or an ester of a (meth)acrylic acid and an aromatic alcohol having a carbon number of 6 to 14); and a low molecular weight tackifier resin having a polymerizable unsaturated bond.

[Radical Polymerization-Type Ink Composition]

The radical polymerization-type ink composition contains (d) a radical polymerizable compound, (e) a polymerization initiator and, if desired, may further contain a colorant, a sensitizing dye, a co-sensitizer and the like.

The constituent components used in the radical polymerization-type ink composition are described below in sequence.

(d) [Radical Polymerizable Compound]

The radical polymerizable compound includes, for example, the following compound having an addition-polymerizable ethylenically unsaturated bond.

[Compound Having Addition-Polymerizable Ethylenically Unsaturated Bond]

Examples of the compound having an addition-polymerizable ethylenically unsaturated bond, which can be used in the ink composition of the present invention, include an ester of an unsaturated carboxylic acid (e.g., acrylic acid, methacrylic acid, itaconic acid, crotonic acid, isocrotonic acid, maleic acid) and an aliphatic polyhydric alcohol compound, and an amide of the above-described unsaturated carboxylic acid and an aliphatic polyvalent amine compound.

Specific examples of the ester monomer of an aliphatic polyhydric alcohol compound and an unsaturated carboxylic acid include the followings Examples of the acrylic ester include ethylene glycol diacrylate, triethylene glycol diacrylate, 1,3-butanediol diacrylate, tetramethylene glycol diacrylate, propylene glycol diacrylate, neopentyl glycol diacrylate, trimethylolpropane triacrylate, trimethylolpropane tri(acryloyloxypropyl)ether, trimethylolethane triacrylate, hexanediol diacrylate, 1,4-cyclohexanediol diacrylate, tetraethylene glycol diacrylate, pentaerythritol diacrylate, pentaerythritol triacrylate, pentaerythritol tetraacrylate, dipentaerythritol diacrylate, dipentaerythritol hexaacrylate, sorbitol triacrylate, sorbitol tetraacrylate, sorbitol pentaacrylate, sorbitol hexaacrylate, tri(acryloyloxyethyl)isocyanurate, and polyester acrylate oligomer.

Examples of the methacrylic acid ester include tetramethylene glycol dimethacrylate, triethylene glycol dimethacrylate, neopentyl glycol dimethacrylate, trimethylolpropane trimethacrylate, trimethylolethane trimethacrylate, ethylene glycol dimethacrylate, 1,3-butanediol dimethacrylate, hexanediol dimethacrylate, pentaerythritol dimethacrylate, pentaerythritol trimethacrylate, pentaerythritol tetramethacrylate, dipentaerythritol dimethacrylate, dipentaerythritol hexamethacrylate, sorbitol trimethacrylate, sorbitol tetramethacrylate, bis[p-(3-methacryloxy-2-hydroxypropoxy)-phenyl]dimethylmethane, and bis[p-(acryloxyethoxy)phenyl]-dimethylmethane. Examples of itaconic acid ester include ethylene glycol diitaconate, propylene glycol diitaconate, 1,3-butanediol diitaconate, 1,4-butanediol diitaconate, tetramethylene glycol diitaconate, pentaerythritol diitaconate, and sorbitol tetraitaconate.

Examples of the crotonic acid ester include ethylene glycol dicrotonate, tetramethylene glycol dicrotonate, pentaerythritol dicrotonate, and sorbitol tetradicrotonate. Examples of the isocrotonic acid ester include ethylene glycol diisocrotonate, pentaerythritol diisocrotonate and sorbitol tetraisocrotonate. Examples of the maleic acid ester include ethylene glycol dimaleate, triethylene glycol dimaleate, pentaerythritol dimaleate and sorbitol tetramaleate. In addition, a mixture of these ester monomers may also be used. Specific examples of the amide monomer of an aliphatic polyvalent amine compound and an unsaturated carboxylic acid include methylenebis-acrylamide, methylenebis-methacrylamide, 1,6-hexamethylenebis-acrylamide, 1,6-hexamethylenebis-methacrylamide, diethylene triamine trisacrylamide, xylylenebisacrylamide, and xylylenebismethacrylamide.

Other examples include a vinyl urethane compound containing two or more polymerizable vinyl groups within one molecule, which is obtained by adding a hydroxyl group-containing vinyl monomer represented by the following formula (A) to a polyisocyanate compound containing two or more isocyanate groups within one molecule, described in JP-B-48-41708. $CH_2{=}C(R)COOCH_2CH(R')OH$ (A) (wherein R and R' each represents H or $CH_3$).

Still other examples include a functional acrylate or methacrylate such as urethane acrylates described in JP-A-51-37193, polyester acrylates described in JP-A-48-64183, JP-B-49-43191 and JP-B-52-30490, and epoxy acrylates obtained by reacting an epoxy resin and a (meth)acrylic acid. Furthermore, those described as a photocurable monomer or oligomer in *Journal of the Adhesion Society of Japan*, Vol. 20, No. 7, pp. 300-308 (1984) may also be used. In the present invention, these monomers can be used in a chemical form such as a prepolymer, namely, dimer, trimer or oligomer, or a mixture or copolymer thereof The amount of the radical polymerizable compound used is usually from 1 to 99.99%, preferably from 5to 90.0%, more preferably from 10 to 70% ("%" as usedherein indicates "mass %"), based on all components of the ink composition.

(e) [Photopolymerization Initiator]

The photopolymerization initiator for use in the radical polymerization-type ink composition of the present invention is described below.

The photopolymerization initiator as used in the present invention indicates a compound capable of undergoing a chemical change under the action of light or through interaction with the electron excited state of a sensitizing dye and thereby producing at least one species of a radical, an acid and a base.

Preferred examples of the photopolymerization initiator include (i) aromatic ketones, (ii) an aromatic onium salt compound, (iii) an organic peroxide, (iv) a hexaarylbiimidazole compound, (v) a ketoxime ester compound, (vi) a borate compound, (vii) an azinium compound, (viii) a metallocene compound, (vix) an active ester compound, and (x) a carbon-halogen bond-containing compound.

[Colorant]

A colorant the same as those described for the colorant regarding the cationic polymerization-type ink composition may be utilized.

In the ink composition of the present invention, in addition to the above-described essential components, various additives may be used in combination according to the purpose. These arbitrary components are described below.

[Sensitizing Dye]

In the present invention, a sensitizing dye may be added for the purpose of improving the sensitivity of the photopolymerization initiator. Preferred examples of the sensitizing dye include those belonging to the following compounds and having an absorption wavelength in the region from 350 to 450 nm.

That is, the compounds are polynuclear aromatics (e.g., pyrene, perylene, triphenylene), xanthenes (e.g., fluorescein, eosin, erythrosin, Rhodamine B, Rose Bengale), cyanines (e.g., thiacarbocyanine, oxacarbocyanine), merocyanines (e.g., merocyanine, carbomerocyanine), thiazines (e.g., thionine, Methylene Blue, Toluidine Blue), acridines (e.g., Acridine Orange, chloroflavin, acriflavine), anthraquinones (e.g., anthraquinone), squaryliums (e.g., squarylium), and coumarins (e.g., 7-diethylamino-4-methylcoumarin).

[Co-sensitizer]

Furthermore, in the ink of the present invention, a known compound having an activity of, for example, more enhancing the sensitivity or suppressing the polymerization inhibition by oxygen may be added as a co-sensitizer.

Examples of such a co-sensitizer include amines such as compounds described in M. R. Sander, et al., *Journal of Polymer Society*, Vol. 10, page 3173 (1972), JP-B-44-20189, JP-A-51-82102, JP-A-52-134692, JP-A-59-138205, JP-A-60-84305, JP-A-62-18537, JP-A-64-33104, and *Research Disclosure*, No. 33825. Specific examples thereof include triethanolamine, ethyl p-dimethylaminobenzoate, p-formyldimethylaniline and p-methylthiodimethylaniline.

Other examples include thiols and sulfides such as thiol compounds described in JP-A-53-702, JP-B-55-500806, and JP-A-5-142772 and disulfide compounds described in JP-A-56-75643. Specific examples thereof include 2-mercaptobenzothiazole, 2-mercaptobenzoxazole, 2-mercaptobenzimidazole, 2-mercapto-4(3H)-quinazoline and β-mercaptonaphthalene.

Still other examples include an amino acid compound (e.g., N-phenylglycine), organometallic compounds described in JP-B-48-42965 (e.g., tributyltin acetate), hydrogen donors described in JP-B-55-34414, sulfur compounds described in JP-A-6-308727 (e.g., trithian), phosphorus compounds described in JP-A-6-250387 (e.g., diethyl phosphite), and Si—H and Ge—H compounds described in Japanese Patent Application No. 6-191605.

Also, in view of enhancing the storability, a polymerization inhibitor is preferably added in an amount of 200 to 20,000 ppm. The ink for ink-jet recording of the present invention is preferably ejected after heating it in the range from 40 to 80° C. and thereby decreasing the viscosity, and also for preventing head clogging due to thermal polymerization, addition of a polymerization inhibitor is preferred. Examples of the polymerization inhibitor include hydroquinone, benzoquinone, p-methoxyphenol, TEMPO, TEMPOL and cupferron Al.

[Others]

In addition, known compounds may be used as needed. For example, a surfactant, a leveling additive, a matting agent and, for adjusting the film physical properties, a polyester-based resin, a polyurethane-based resin, a vinyl-based resin, an acryl-based resin, a rubber-based resin or waxes, may be appropriately selected and used. Furthermore, in order to improve the adhesion to a recording medium such as polyolefin and PET, a tackifier which does not inhibit the polymerization is also preferably contained. Specific examples thereof include high molecular weight adhesive polymers described in JP-A-2001-49200, pp. 5-6 (for example, a copolymer comprising an ester of a (meth)acrylic acid and an alcohol containing an alkyl group having a carbon number of 1 to 20, an ester of a (meth)acrylic acid and an alicyclic alcohol having a carbon number of 3 to 14, or an ester of a (meth)acrylic acid and an aromatic alcohol having a carbon number of 6 to 14); and a low molecular weight tackifier resin having a polymerizable unsaturated bond.

Also, addition of an organic solvent in an extremely small amount is effective for the purpose of improving adhesion to a recording medium. In this case, addition in the range of not causing a problem in the solvent resistance or VOC is effective, and this amount is preferably from 0.1 to 5 mass %, more preferably from 0.1 to 3 mass %, based on the entire ink composition.

Furthermore, as the means for preventing reduction in the sensitivity due to light-shielding effect of the coloring material in the ink, it is also one preferred embodiment to form a radical/cation hybrid-type curing ink by combining a cationic polymerizable monomer having a long life as the polymerization initiator with a polymerization initiator.

[Aqueous Ink Composition]

The aqueous ink composition contains a polymerizable compound and a water-soluble photopolymerization initiator capable of generating a radical under the action of active energy and if desired, may further contain a coloring material and the like.

[Polymerizable Compound]

As for the polymerizable compound contained in the aqueous ink composition of the present invention, a polymerizable compound contained in known aqueous ink compositions may be used.

In the aqueous ink composition, a reactive material may be added so as to optimize the formulation by taking into account end user characteristics such as curing rate, adhesion and flexibility. For example, a (meth)acrylate (namely, acrylate and/or methacrylate) monomer or oligomer, an epoxide and an oxetane are used as such a reactive material.

Examples of the acrylate monomer include a phenoxyethyl acrylate, an octyldecyl acrylate, a tetrahydrofuryl acrylate, an isobornyl acrylate, a hexanediol diacrylate, a trimethylolpropane triacrylate, a pentaerythritol triacrylate, a polyethylene glycol diacrylate (e.g., tetraethylene glycol diacrylate), a dipropylene glycol diacrylate, a tri(propylene glycol)triacrylate, a neopentyl glycol diacrylate, a bis(pentaerythritol) hexaacrylate, an acrylate of ethoxylated or propoxylated glycol and polyol (e.g., propoxylated neopentyl glycol diacrylate, ethoxylated trimethylolpropane triacrylate), and a mixture thereof.

Examples of the acrylate oligomer include an ethoxylated polyethylene glycol, an ethoxylated trimethylolpropane acrylate, a polyether acrylate including its ethoxylated product, and a urethane acrylate oligomer.

Examples of the methacrylate include a hexanediol dimethacrylate, a trimethylolpropane trimethacrylate, a triethylene glycol dimethacrylate, a diethylene glycol dimethacrylate, an ethylene glycol dimethacrylate, a 1,4-butanediol dimethacrylate, and a mixture thereof.

The amount of the oligomer added is preferably from 1 to 80 wt %, more preferably from 1 to 10 wt %, based on the entire weight of the ink composition.

[Water-Soluble Photopolymerization Initiator Capable of Producing a Radical Under the Action of Active Energy]

The polymerization initiator which can be used in the ink composition of the present invention is described below. As one example, a photopolymerization initiator up to a wavelength of around 400 nm may be used. Examples of such a photopolymerization initiator include photopolymerization initiators represented by the following formulae, which are a substance having functionality in a long wavelength region, namely, sensitivity of producing a radical when irradiated with ultraviolet rays (hereinafter simply referred to as a "TX system"). In the present invention, particularly, a photopolymerization initiator appropriately selected from these is preferably used.

TX-1

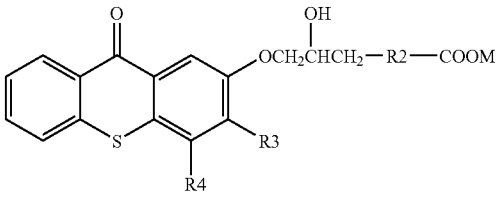

TX-2

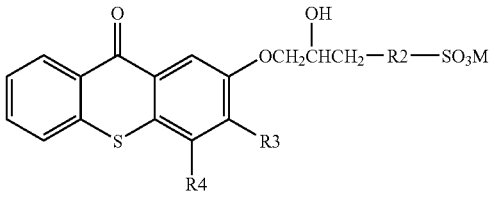

TX-3

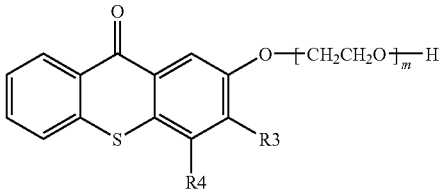

In formulae TX-1 to TX-3, R2 represents —$(CH_2)_x$— (wherein x is 0 or 1), —O—$(CH_2)_y$— (wherein y is 1 or 2), or a substituted or unsubstituted phenylene group. When R2 is a phenylene group, at least one of the hydrogen atoms in the benzene ring may be substituted by one group or atom or two or more groups or atoms selected from, for example, a carboxyl group or a salt thereof, a sulfonic acid or a salt thereof, a linear or branched alkyl group having a carbon number of 1 to 4, a halogen atom (e.g., fluorine, chlorine, bromine), an alkoxyl group having a carbon number of 1 to 4, and an aryloxy group such as phenoxy group. M represents a hydrogen atom or an alkali metal (e.g., Li, Na, K). R3 and R4 each independently represents a hydrogen atom or a substituted or unsubstituted alkyl group. Examples of the alkyl group include a linear or branched alkyl group having a carbon number of approximately from 1 to 10, particularly, a carbon number of approximately from 1 to 3. Examples of the substituent for this alkyl group include a halogen atom (e.g., fluorine, chlorine, bromine), a hydroxyl group, and an alkoxyl group (having a carbon number of approximately from 1 to 3). m represents an integer of 1 to 10.

In the present invention, a water-soluble derivative of a photopolymerization initiator, Irgacure 2959 (trade name, produced by Ciba Specialty Chemicals), represented by the following formula (hereinafter simply referred to as an "IC system") may be used. Specifically, IC-1 to IC-3 of the following formulae may be used.

Formula:

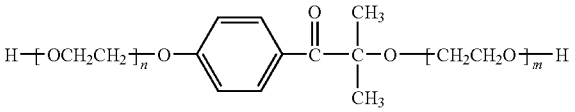

(n = 2 ~ 5, m = 0 ~ 5)

IC-1

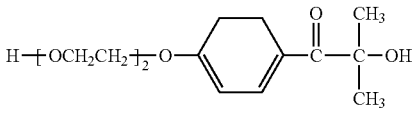

IC-2

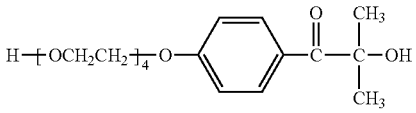

IC-3

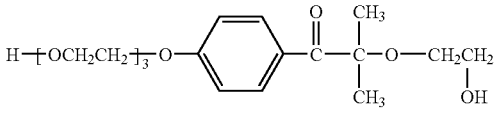

[Formulation for Clear Ink]

By using the water-soluble polymerizable compound in the form of a transparent aqueous ink without incorporating the above-described coloring material, a clear ink can be prepared. In particular, when the ink is prepared to have ink-jet recording property, an aqueous photocuring-type clear ink for ink-jet recording is obtained. This ink contains no coloring material and therefore, a clear film can be obtained by using the ink. Examples of the usage of the coloring material-free clear ink include use as an undercoat for imparting suitability for image printing to a recording material, and use as an overcoat for protecting the surface of an image formed by a normal ink or further imparting decoration, gloss or the like. In the clear ink, a colorless pigment, a fine particle or the like not for the purpose of coloration may be incorporated by dispersion according to the usage above. By this addition, various properties such as image quality, fastness and processability (handling property) of a printed matter can be enhanced in both cases of undercoat and overcoat.

As for the formulation conditions in such application to a clear ink, the ink is preferably prepared to contain a water-soluble polymerizable compound as the main component of the ink in a proportion of 10 to 85% and a photopolymerization initiator (for example, an ultraviolet polymerization catalyst) in an amount of 1 to 10 parts by mass per 100 parts by mass of the water-soluble polymerizable compound and at the same time, contain a photopolymerization initiator in an amount of at least 0.5 parts per 100 parts of the ink.

[Material Construction in Coloring Material-Containing Ink]

In the case of using the water-soluble polymerizable compound for a coloring material-containing ink, the concentrations of the polymerization initiator and polymerizable substance in the ink are preferably adjusted according to the absorption characteristics of the coloring material contained. As described above, the blending amount is set such that the amount of water or solvent is, on the mass basis, from 40 to 90%, preferably from 60 to 75%. Also, the content of the polymerizable compound in the ink is set to, on the mass basis, from 1 to 30%, preferably from 5 to 20%, based on the entire amount of the ink. The amount of the polymerization initiator depends on the content of the polymerizable compound but is generally, on the mass basis, from 0.1 to 7%, preferably from 0.3 to 5%, based on the entire amount of the ink.

In the case where a pigment is used as the coloring material of the ink, the concentration of the pure pigment portion in the ink is generally from 0.3 to 10 mass % based on the entire amount of the ink. The coloring power of the pigment depends on the dispersed state of pigment particles, but when the concentration is approximately from 0.3 to 1%, this is in the range of use as a light color ink, whereas the value exceeding the range above gives a concentration employed for normal coloration.

[Preferred Physical Properties of Ink Composition]

Taking into account the ejection property, the ink composition of the present invention preferably has an ink viscosity of 20 mPa·s or less, more preferably 10 mPa·s or less, at the ejection temperature, and an appropriate compositional ratio is preferably determined to give an ink viscosity in this range.

The surface tension in common of the ink composition of the present invention is preferably from 20 to 40 mN/m, more preferably from 25 to 35 mN/m. In the case of recording an image on various recording mediums such as polyolefins, PET, coated paper and non-coated paper, the surface tension is preferably 20 mN/m or more in view of bleeding and penetration and is preferably 40 mN/m or less in view of wettability.

The thus-prepared ink composition of the present invention is suitably used as an ink for ink-jet recording. In the case of using the ink composition as an ink for ink-jet recording, the ink composition is ejected on a recording medium by an ink-jet printer and the ink composition ejected is then cured by irradiating thereon active energy, whereby recording is performed.

The printed matter obtained using this ink has an image area cured by the irradiation of active energy such as ultraviolet ray and is assured of excellent strength of the image area and therefore, the ink composition can be used for various uses such as formation of an ink-receiving layer (image area) of a lithographic printing plate, other than the formation of an image.

This application is based on Japanese Patent application JP 2007-26961, filed Feb. 6, 2007, the entire content of which is hereby incorporated by reference, the same as if fully set forth herein.

Although the invention has been described above in relation to preferred embodiments and modifications thereof, it will be understood by those skilled in the art that other variations and modifications can be effected in these preferred embodiments without departing from the scope and spirit of the invention.

What is claimed is:

1. An ink-jet recording method for forming an image by discharging a liquid functional material onto a recording medium by a full-line type ink-jet head having discharge nozzles arranged in a widthwise direction substantially perpendicular to a transporting direction of the recording medium, comprising:

determining a range free of image recording between images recorded intermittently on the recording medium;

effecting discharge or pressurization purge of the liquid functional material in the range free of image recording on the recording medium; and lowering a fluidity of the liquid functional material discharged, wherein the lowering of the fluidity is conducted by irradiation with active energy rays.

2. The ink-jet recording method according to claim 1, wherein the discharge or pressurization purge in the range free of image recording is executed with respect to a nozzle which has not been discharging for a predetermined fixed time duration within a period when the probability of occurrence of faulty discharge is low.

3. The ink-jet recording method according to claim 1, wherein the discharge or pressurization purge in the range free of image recording is executed speedily after the occurrence of faulty discharge with respect to a nozzle in which faulty discharge has occurred.

4. The ink-jet recording method according to claim 1, wherein a transport speed of the recording medium is decreased or the transport is stopped only during the execution of the discharge or pressurization purge in the range free of image recording.

5. The ink-jet recording method according to claim 1, wherein during the discharge in the range free of image recording, one of an increase in an amount of droplets per dot and a decrease of a discharge frequency than at least during image recording is carried out.

6. The ink-jet recording method according to claim 5, wherein the increase in the amount of droplets per dot is a voltage increase or an increase in the number of discharge drops.

7. The ink-jet recording method according to claim 1, wherein an inspection pattern is recorded by the discharge in the range free of image recording.

8. The ink jet recording method according to claim 1, wherein the discharge in the range free of image recording indicates a predetermined cutting position between the images.

9. An ink-jet recording apparatus comprising:

a head controller for determining a range free of image recording between images recorded intermittently on a recording medium on the basis of inputted image data, and for effecting discharge or pressurization purge of a liquid functional material within this determined range; and a unit for lowering the fluidity of the liquid functional material discharged, wherein the lowering of the fluidity is conducted by irradiation with active energy rays.

10. The ink-jet recording apparatus according to claim 9, further comprising:

a faulty-discharge-nozzle detector capable of detecting a nozzle in which faulty discharge has occurred.

* * * * *